US005882002A

United States Patent [19]

Kamei et al.

[11] Patent Number: 5,882,002

[45] Date of Patent: Mar. 16, 1999

[54] PAPER FEEDING DEVICE

[75] Inventors: Kyoji Kamei; Takuo Matsumura; Atsushi Yoshida, all of Ebina, Japan

[73] Assignee: Fuji Xerox Co., Ltd., Tokyo, Japan

[21] Appl. No.: 712,352

[22] Filed: Sep. 11, 1996

[30] Foreign Application Priority Data

Sep. 12, 1995 [JP] Japan ..... 7-233644

[51] Int. Cl.[6] ..... B65H 3/06

[52] U.S. Cl. ..... 271/118; 271/121; 271/125

[58] Field of Search ..... 271/121, 124, 271/125, 118

[56] References Cited

U.S. PATENT DOCUMENTS

| | | | |
|---|---|---|---|
| 4,368,881 | 1/1983 | Landa . | |
| 4,480,827 | 11/1984 | Shultz et al. . | |
| 4,801,134 | 1/1989 | Yokoyama et al. | 271/125 X |
| 5,007,627 | 4/1991 | Giannetti et al. . | |
| 5,039,080 | 8/1991 | Koto et al. | 271/125 X |
| 5,122,841 | 6/1992 | Sasaki . | |
| 5,462,267 | 10/1995 | Hori . | |

FOREIGN PATENT DOCUMENTS

| | | |
|---|---|---|
| 0 072 981 A1 | 8/1982 | European Pat. Off. . |
| 0 314 167 A2 | 10/1988 | European Pat. Off. . |
| 0 357 012 A2 | 8/1989 | European Pat. Off. . |

*Primary Examiner*—David H. Bollinger
*Attorney, Agent, or Firm*—Oliff & Berridge, PLC

[57] ABSTRACT

In a paper feeding device capable of separately transporting paper without reversely rotating a retard roller being provided with feed rollers and retard rollers which separately transport, sheet by sheet, paper fed from paper feed trays by pickup rollers, a rotary drive unit for rotating the feed rollers in a paper transporting direction, and a pressing unit for pressing the retard rollers against the feed rollers. In the paper feeding device, a retard roller braking unit which supports the retard rollers so as to rotate together with the rotation of the peripheral surface of the feed rollers when the retard rollers are pressed against the rotating feed rollers, and which applies a braking force to the rotating retard rollers.

23 Claims, 28 Drawing Sheets

PAPER FEEDING DEVICE

BACKGROUND OF THE INVENTION

1. Field of the Invention

The present invention relates to a paper feeding device for separately transporting paper sheet by sheet from a paper feed tray in an image forming apparatus such as a copier, a facsimile, or a printer.

2. Description of the Related Art

The following technique as shown in FIGS. 26 and 27 has been known for use in such a paper feeder.

FIGS. 26 and 27 are explanatory illustrations of a conventional paper feeder which feeds paper from a paper feed tray.

In FIG. 26, a plurality of paper feed trays 01 are vertically stacked on top of each other. Each paper feed tray 01 is provided with a paper loaded plate 02 for supporting, in a raisable manner, that part of a lower surface of the paper piled in the paper feed tray which is close to a paper feed unit, paper side edge positioning members 03 for positioning the side edges of the paper housed in the tray, and a paper front edge support wall 04 for positioning the front edge of the paper in the transportation direction thereof.

A paper feed unit 06 is disposed in the direction perpendicular to the sheet of FIG. 26 along the side of each paper feed tray 01 close to the paper feed unit (i.e., the right side portion of the paper feed tray). The paper feed unit 06 comprises a pickup roller 07 for feeding the paper stored in the paper feed tray 01, a pivotal arm 08 for supporting the pickup roller 07, a tension spring 010 which pulls the pivotal arm 08 such that it downwardly presses the pickup roller 07, and a separately transporting roller 011 which comprises a feed roller 011*a* and a retard roller 011*b* which separately transport the received paper sheet by sheet.

The separately transporting roller 011 is disposed in front of the paper feed tray 01 in the paper feeding direction, and the pickup roller 07 is disposed above the paper feed tray 01. The pickup roller 07, the pivotal arm 08 for supporting the pickup roller 07, and a gear 12 for transmitting torque to the pickup roller 07 are disposed between the lower surface of an upper paper feed tray 01 and the upper surface of the paper loaded in a lower paper feed tray 01.

In FIG. 27, the pivotal arm 08 is provided with a supported pin 08*a* and a light shielding section 08*b* for detecting the position of the supported pin.

An operating link rod 014 and a spring link rod 015, both of which extend downwardly, are fixedly attached to a rotary shaft 013 rotatably supported by a frame (not shown). The lower end of the operating link rod 014 is joined to a leading end of an extendable rod 016*a* of a solenoid 16 so as to be relatively movable in a vertical direction as well as to be relatively rotatable.

The lower end of the spring link rod 015 is joined to a tension spring 017. When the lower end of the spring link rod 015 is downwardly pulled by means of the tension spring 017, the rotary shaft 013 and the operating link rod 014 rotate, which in turn results in the extendable rod 016*a* being extended.

When the extendable rod 016*a* contracts as a result of the solenoid 016 being turned on, the operating link rod 014, the rotary shaft 013, and the spring link rod 015 rotate.

A pin rasing member 013*a* is attached to the rotary shaft 013. When the solenoid 016 is in an OFF state, the rotary shaft 013 rotates via the spring joint rod 015 pulled by the tension spring 017, whereby the pin raising member 013*a* is retained in an elevated position. The pin raising member 013*a*, which is retained in the elevated position while the solenoid 016 is in the OFF state, raises the supported pin 08*a*. While the supported pin 08*a* is held in the raised condition, the pivotal arm 08 is also retained in an elevated position.

A position sensor 018 is fixedly supported by a frame (not shown) and comprises a light emitting sensor 018*a* and a light receiving sensor 018*b* which are spaced apart from each other. While the light shielding section 08*b*, which vertically moves in conjunction with the vertical movement of the pivotal arm 08, is in an elevated position, it is sandwiched between the light emitting sensor 018*a* and the light receiving sensor 018*b*.

A retard roller support frame 021 for supporting the retard roller 011*b* is supported by a support shaft 022 so as to pivot thereon. The retard roller support frame 021 is retained by a coiled tension spring 023 in such a position as to press the retard roller 011*b* against the feed roller 011*a*.

A retard roller support shaft 024 rotatably supported by the retard roller support frame 021 rotatably supports the retard roller 011*b* via a torque limiter 025. A gear 026 is attached to the retard roller support shaft 024.

A frame F supports a retard roller drive gear 027 which rotates around the support shaft 022.

When the retard roller drive gear 027 rotates, the gear 026 and the retard roller support shaft 024 are rotatably actuated. Resultant torque is transmitted to the retard roller 011*b* via the torque limiter 025.

The rotation direction of the retard roller 011*b* is set to be opposite to the paper feeding direction.

FIG. 28 is a diagrammatic representation for explaining the principle operation of the traditional paper feeder shown in FIGS. 26 and 27. With reference to FIG. 28, an explanation will now be given of the case where no paper or only one sheet of paper is pinched by a nipping section (that is, a contact area) between the feed roller 011*a* and the retard roller 011*b*. When the feed roller 011*a* rotates so as to transport the paper from left to right in FIG. 28, the retard roller 011*b* receives force in the paper feeding direction, from the feed roller 011*a* or the paper at the nipping section. At this time, the retard roller 011*b* rotates in a following manner in the direction opposite to the retard roller support shaft 024 that rotates in the direction opposite to the paper feeding direction (i.e., the retard roller 011*b* rotates in the direction in which the paper is fed). Arrows P1 to P3 shown in FIG. 28 designate the following forces:

P1: a tensile force of the tension spring 023,

P2: an upward force which the gear 026 receives from the retard roller drive gear 027 in a meshed section between them in reaction to the force transmitted by the torque limiter 025, and P3: a pulling force which the retard roller 11*b* receives from the feed roller 011*a* by way of the nipping section in reaction to the force transmitted by the torque limiter 025.

Based on the assumption that distances between the center of the support shaft 022 and action lines of the forces P1, P2, and P3 are L1, L2, and L3, respectively, the sum of angular moments of the forces P1, P2, and P3 in the case of the feed roller shown in FIG. 28 can be expressed by the following expression:

$$P1 \times L1 + P2 \times L2 + P3 \times L3.$$

Provided that a force (i.e., a retarding pressure) by which the retard roller 011*b* is pressed against the feed roller 011*a* by means of the angular moments is P, and that the distance between the action line of the retarding pressure P and the center of the support shaft 22 is L, the retarding pressure P can be expressed by the following expression.

$$P=(P1\times L1+P2\times L2+P3\times L3)/L$$

The paper transported between the feed roller 11*a* and 11*b* is separated sheet by sheet and fed on the basis of the retarding pressure P.

[Problems to be Solved by the Invention]

With reference to FIGS. 29 and 30, the operation of the paper feed unit carried out when the retard roller 011*b* is reversely rotated so as to return the paper to the paper feed tray 01 will now be described.

Usually, the top few sheets of the paper loaded in the paper feed tray 01 are transported to the nipping section between the feed roller 011*a* and the retard roller 011*b* by means of the pickup roller 07.

Assume that two sheets of paper are introduced into the nipping section, as shown in FIG. 29A. Even if a lower sheet of paper tries to exceed the nipping section and advance further together with an upper sheet of paper currently being fed, the lower sheet of paper is returned to the nipping section by the retard roller 011*b* which reversely rotates, as shown in FIG. 29B. If the retard roller 011*b* is not reversely rotated, the lower sheet of paper remains in a stopped state at the position to which the lower sheet of paper advanced, as shown in FIG. 29C. If the stop position reaches a transport roller disposed in a downstream direction, the two sheets of paper are transported while overlapping with each other.

Assume that three sheets of paper are introduced into the nipping section, as shown in FIG. 30A. If the retard roller 011*b* is reversely rotated, it is possible to arrange the paper by returning the lowermost sheet of paper to the nipping section first and, subsequently, the second sheet of paper to the nipping section, as shown in FIG. 30B. If the retard roller 011*b* is not reversely rotated, the lowermost sheet of paper and the middle sheet of paper are separated from each other, as a result of which the top two sheets of paper may be fed together in an overlapped manner, as shown in FIG. 30C.

Overlapped sheets of paper are more frequently transported when there is a high probability of the top several sheets of paper being introduced into the nipping section by the pickup roller 70, that is, in the case where the paper is fed and introduced into the nipping section at high speed with an increased inertial force. The reverse rotation of the retard roller 011*b* contributes to the prevention of transportation of overlapped sheets of paper at a relatively high speed. If the paper is not fed at such a speed, the use of the drive force transmission means for reverse drive purposes adds to the cost of the paper feeder. Further, if the retard roller 011*b* is reversely rotated, load torque and power consumption increase, which in turn leads to increased noise.

SUMMARY OF THE INVENTION

The inventors of the present invention have made a study of a separately transporting mechanism capable of preventing the transportation of overlapped sheets of paper without use of means for reversely rotating the retard roller.

As a result, if the retard roller is fixed, or if a fixed frictional member for separating purposes is used in lieu of the retard roller, no problems associated with the separation performance arise. However, the feed roller receives increased load. Further, the feed roller wears heavily, which in turn shortens the life of parts. In this way, other problems arise as a result of the use of fixing of the retard roller of the use of the fixed frictional member.

The study revealed that sufficient separating and transporting functions could be obtained by supporting the retard roller so as to be able to follow the feed roller, and exerting a braking force on the retard roller in the following manner.

The present invention has been conceived in view of the above-described drawbacks in the conventional art and the result of the study, and it is an object of the present invention to provide a paper feeding device capable of separating and transporting paper without reversely rotating the retard roller, being smaller load torque of the feed roller and lower power consumption; and reducing noise.

A paper feeding device according to the present invention is comprised of: a pickup roller for feeding paper loaded in a paper feed tray; a feed roller and a retard roller which separately transport the paper received from the paper feed tray sheet by sheet; rotary drive unit for rotating the feed roller in a paper transporting direction; pressing unit for pressing the retard roller against the feed roller, the retard roller being rotatable together with a rotation of a peripheral surface of the feed roller when pressed against the feed roller when the feed roller rotates; and retard roller braking unit for exerting a braking force on the retard roller when the retard roller rotates.

In the paper feeding device according to the present invnetion, the pickup rollers feed the paper loaded in the paper feed trays. The feed rollers of the feed rollers and the retard rollers are rotated in the direction in which the paper is transported by means of the rotary driving means. The retard rollers are pressed against the feed rollers by the pressing means. When being pressed against the feed roller which is rotating, the retard rollers rotate together with the rotary movement of the peripheral surface of the feed rollers. The retard roller braking means exerts a braking force on the retard rollers.

The paper fed out of the paper feed trays enters a nipping section between the feed rollers and the retard rollers which arranged one on top of the other. If two sheets of paper enter the nipping section, the top sheet of paper is transported in the direction in which the paper is fed by means of the feed rollers. The lower sheet of paper is in contact with the retard rollers, and the rotation of the retard rollers is slowed down by means of the braking force. Therefore, the lower sheet of paper is transported slower than the top sheet of paper when they enter the nipping section. In the end, the lower sheet of paper comes to a stop together with the retard rollers.

PREFERRED EMBODIMENTS OF THE INVENTION

Figure 1:
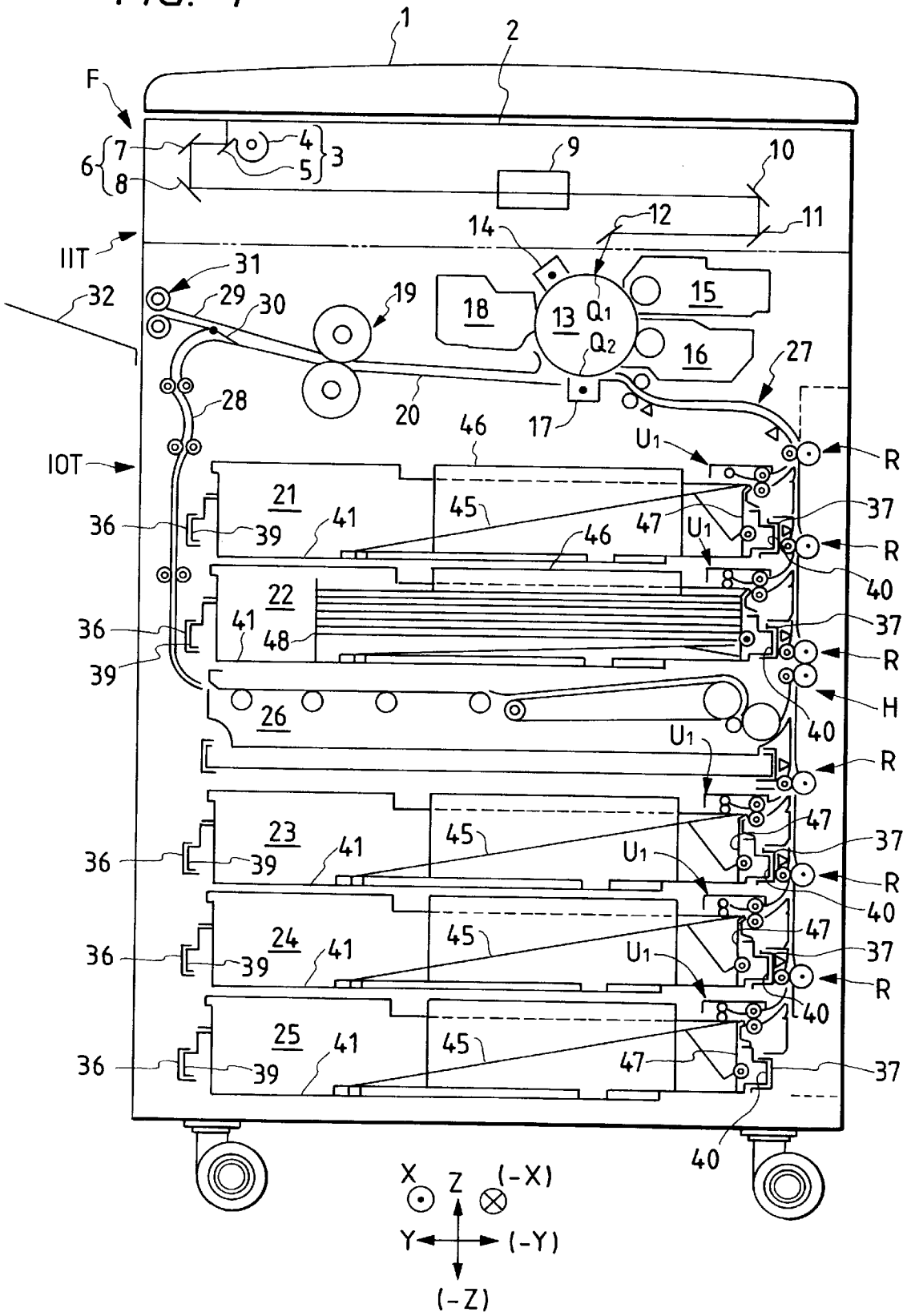
FIG. 1 is a schematic representation showing the entire structure of a copier which incorporates a paper feeder according to a first embodiment of the present invention.

With reference to the accompanying drawings, the embodiments of the present invention will now be described. However, the present invention is not limited to the following embodiments.

To provide an easy understanding of the invention, rectangular coordinate axes X, Y, and Z are defined in the X, Y, and Z directions intersecting at right angles in the drawing. The direction designated by the arrow X is a forward direction, the direction designated by the arrow Y is a leftward direction, and the direction designated by the arrow Z is an upward direction. In this case, the direction (i.e., −X direction) opposite to the X direction (the forward direction) is a rearward direction, the direction (i.e., −Y direction) opposite to the Y direction (the leftward direction) is a rightward direction, and the direction (i.e., −Z direction) opposite to the Z direction (the upward direction) is a downward direction.

The forward direction (i.e., the X direction) and the rearward direction (i.e., the −X direction) will be simply referred to as a front-to-back direction or the X-axis direction. The leftward direction (i.e., the Y direction) and the rightward direction (i.e., the −Y direction) will be simply referred to as a right-to-left direction or the Y-axis direction. The upward direction (i.e., the Z direction) and the downward direction (i.e., the −Z direction) will be simply referred to as a vertical direction or the Z-axis direction.

Moreover, encircled dot designates an arrow which passes through a sheet of paper from its rear to front, whereas encircled cross designates an arrow which passes through the sheet of paper from its front to rear.

First Embodiment

With reference to FIGS. 1 through 7, a paper feeder according to a first embodiment of the present invention will be described.

Figure 2:
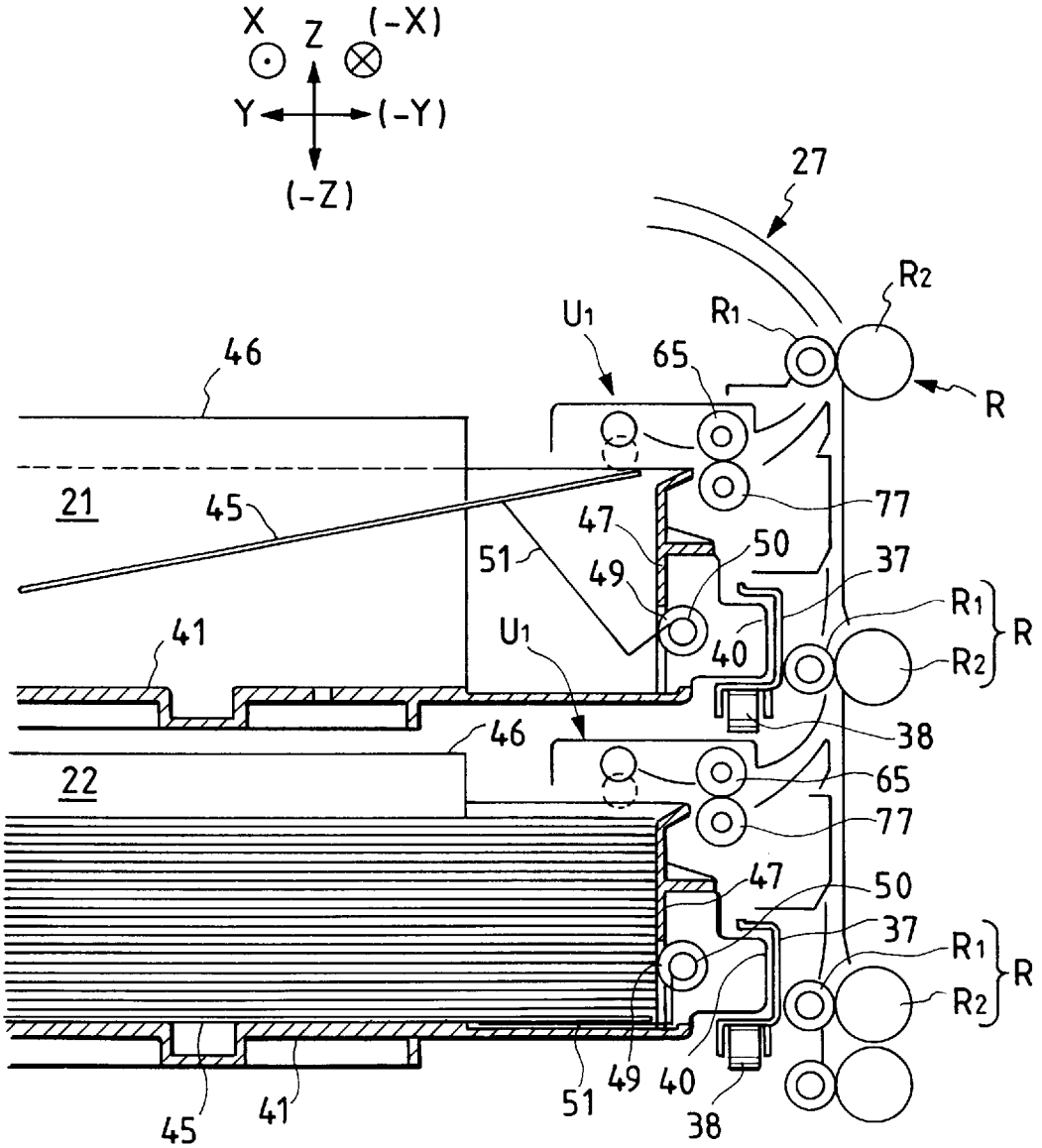
FIG. 2 is an enlarged view of the principle elements shown in FIG. 1 for illustrating the paper feeder of the first embodiment.
Figure 3:
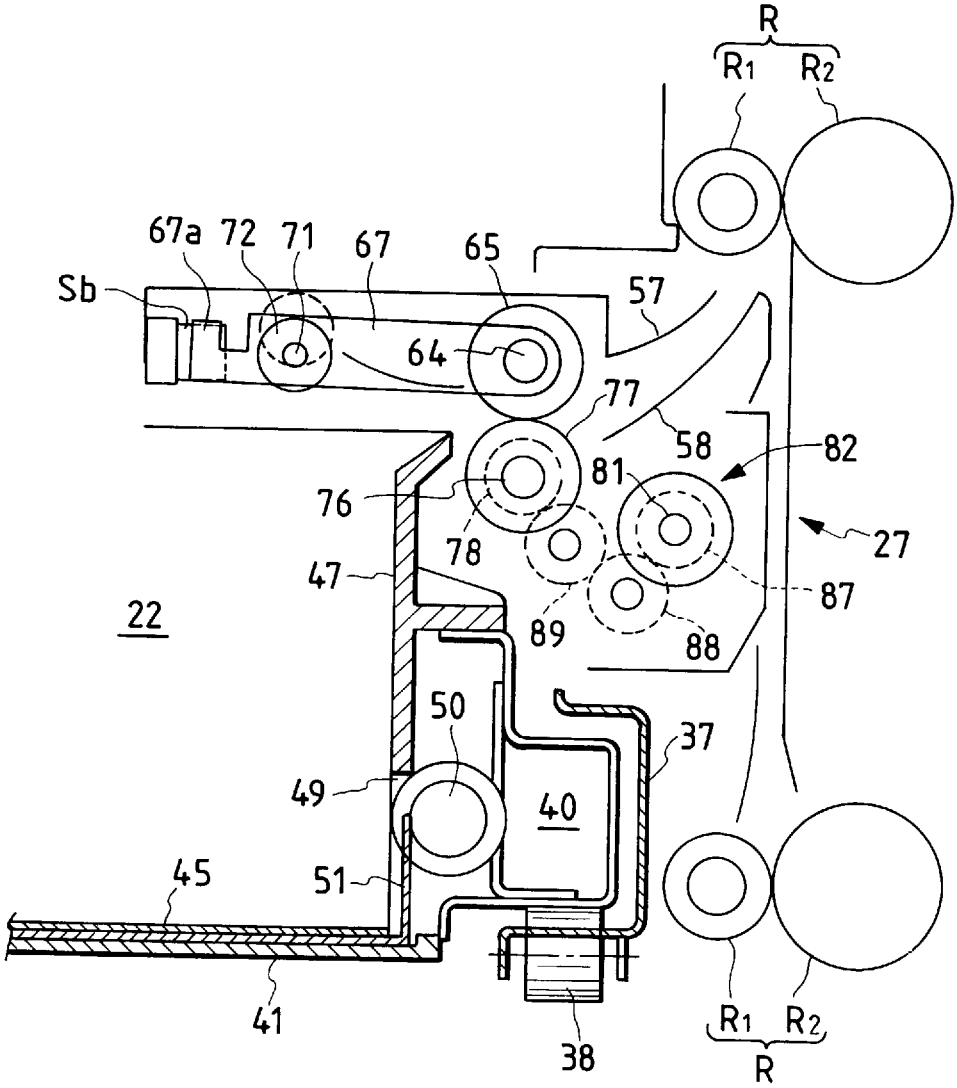
FIG. 3 is an enlarged view of the principle elements shown in FIG. 2 for illustrating the paper feeder of the first embodiment.
Figure 4:
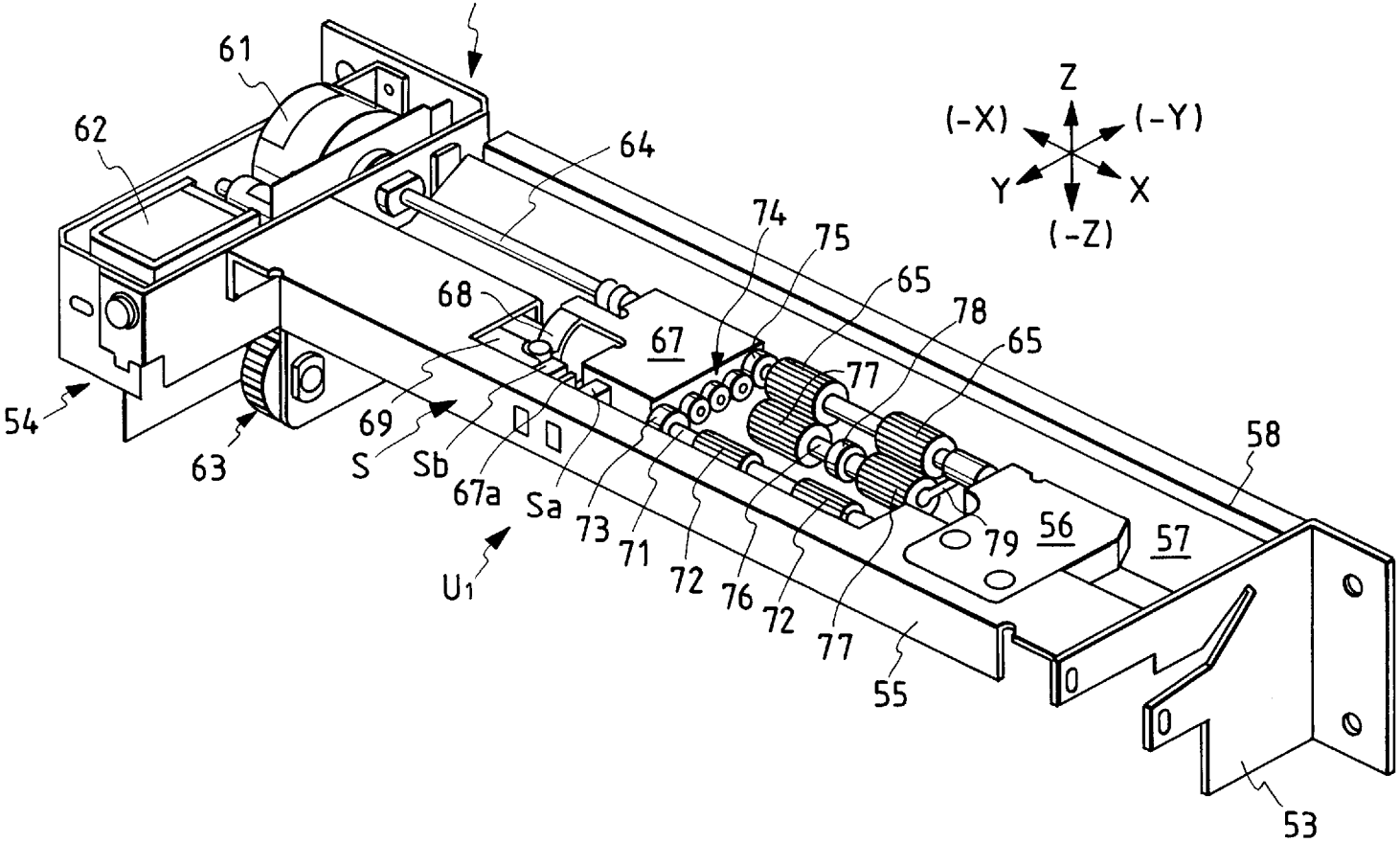
FIG. 4 is a perspective view of the paper feeder of the first embodiment.
Figure 5:
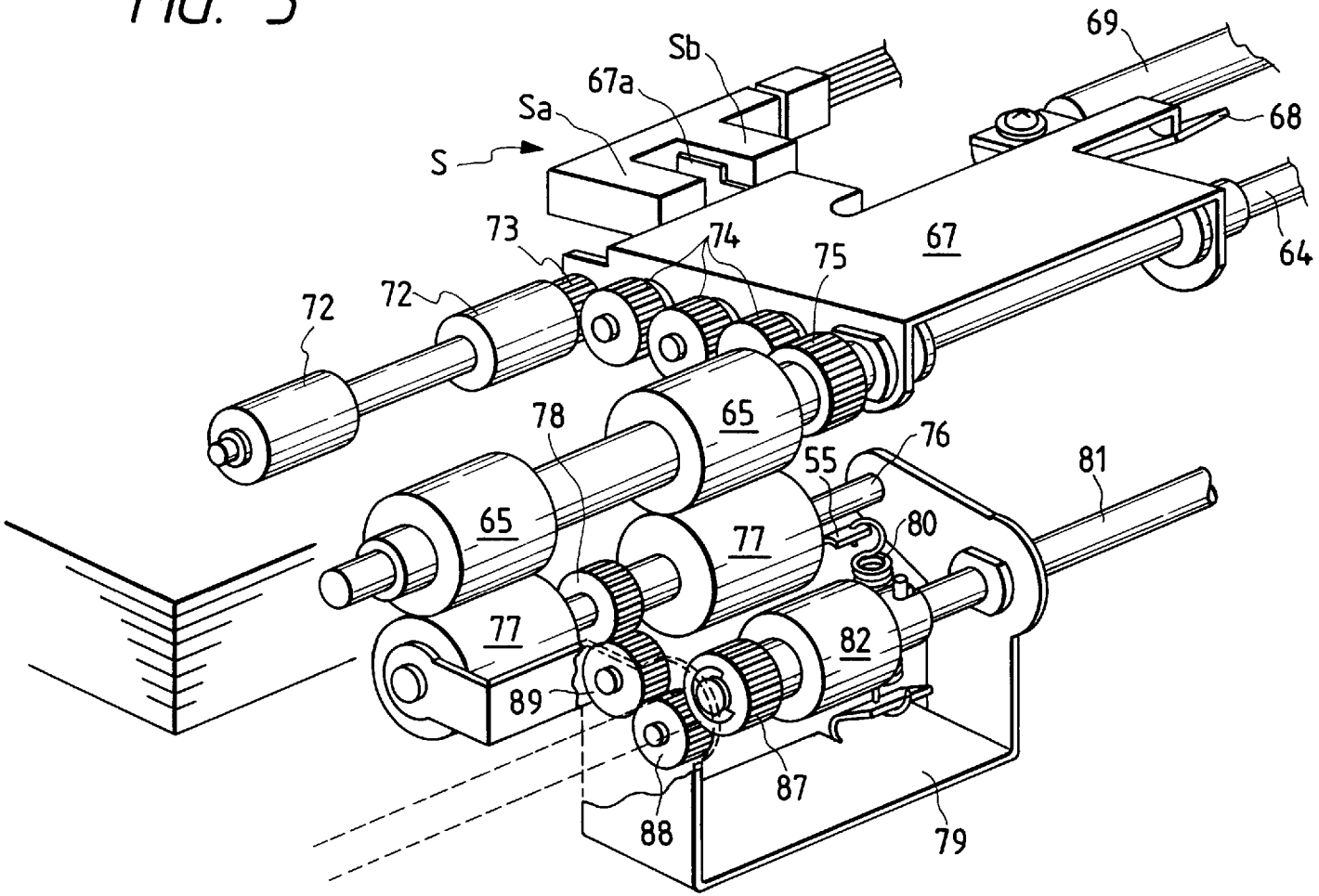
FIG. 5 is a perspective view of the principle elements of the paper feeder of the first embodiment which shows a mechanism to press retard rollers against feed rollers.
Figure 6:
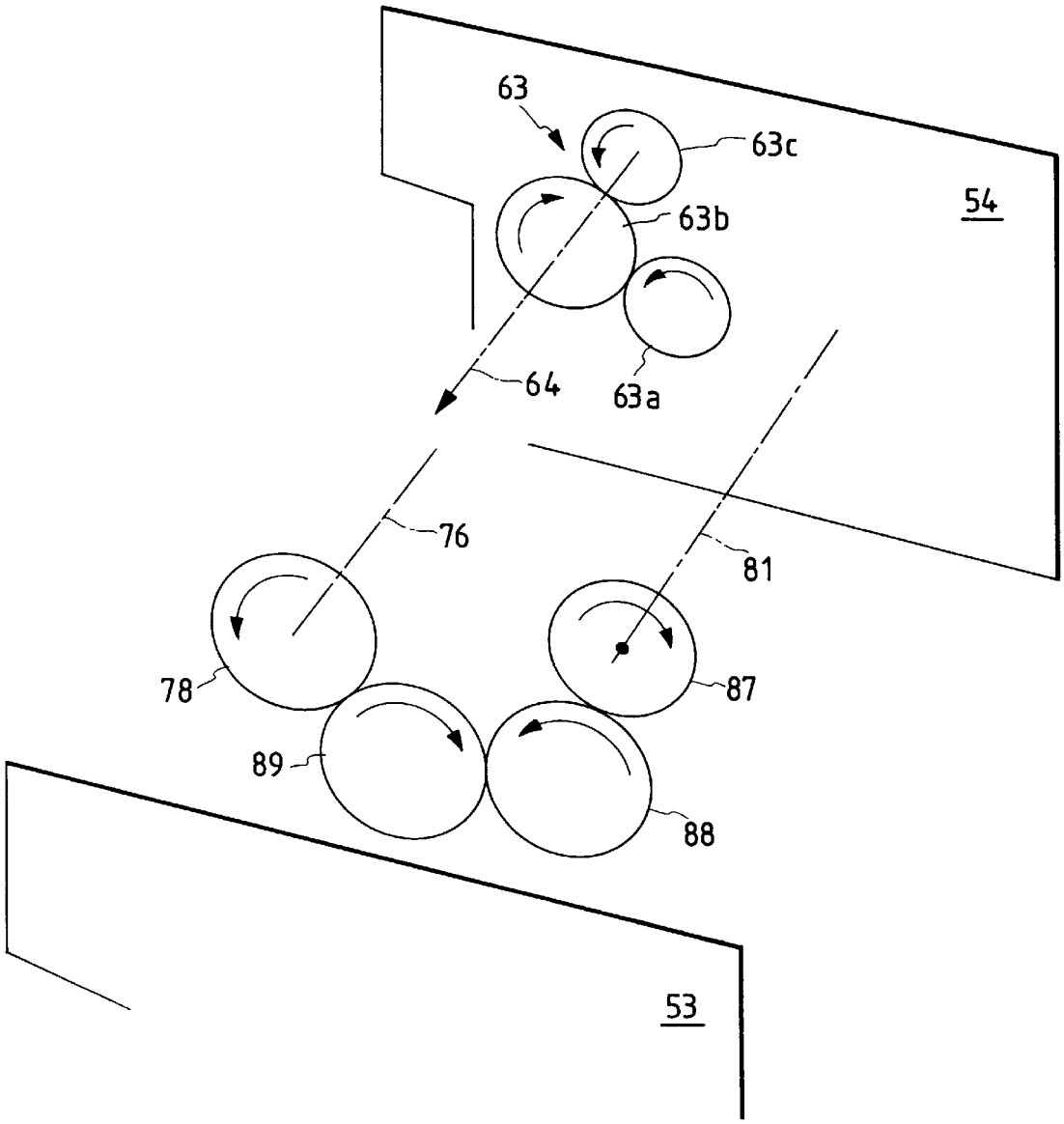
FIG. 6 is an explanatory illustration of a power transmission mechanism of the paper feeder of the first embodiment.
Figure 7:
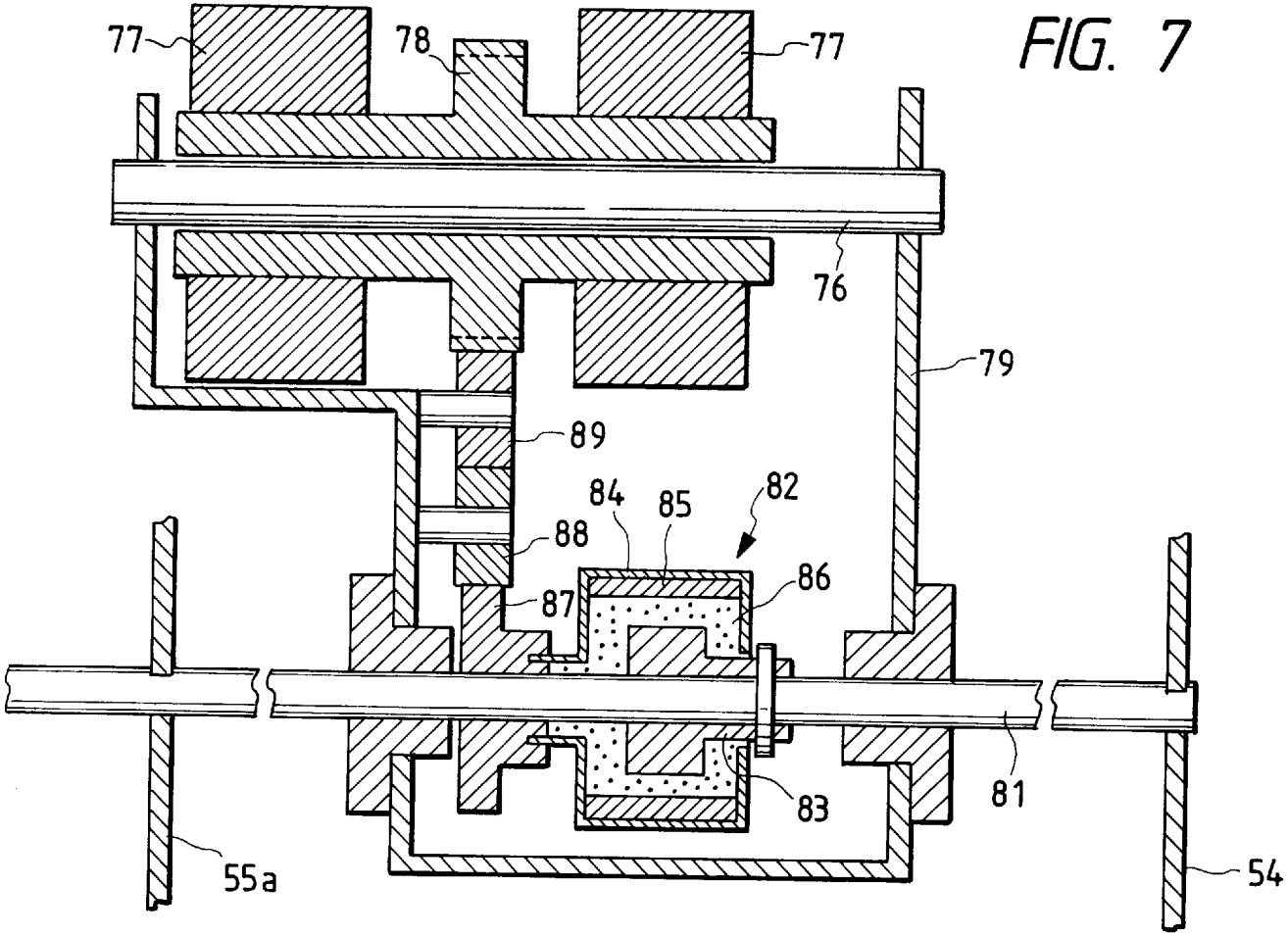
FIG. 7 is an explanatory illustration of a retard roller supporting structure of the paper feeder of the first embodiment.

FIG. 1 is a general illustration of a copier which incorporates a paper feeder according to a first embodiment of the present invention. FIG. 2 is a partial enlarged view of FIG. 1. FIG. 3 is an illustration of the paper feeder according to the first embodiment of the present invention. FIG. 4 is a perspective view of the paper feeder according to the first embodiment of the present invention. FIG. 5 is a perspective view of the principle elements of the paper feeder of the first embodiment, and a mechanism to press a feed roller against a retard roller is shown in FIG. 5. FIG. 6 is an illustration of a power transmission mechanism of the paper feeder. FIG. 7 is an illustration of the structure of the paper feeder for supporting the retard roller.

As illustrated in FIG. 1, a copier F incorporating the paper feeder has an open/close cover 1 provided on its upper end, and a transparent platen glass 2 on which the original is placed. The cover 1 is arranged so as to cover the platen glass 2 when it is closed.

An original illuminating unit 3 is provided below the platen glass 2 so as to scan the original placed on the platen glass 2 while illuminating it. The original illuminating unit 3 is provided with an original illuminating light source 4 and a first mirror 5. A mirror unit 6 is provided below the platen glass 2. In order to ensure a constant optical path length over which the light reflected from the original travels to an image forming position, the mirror unit 6 is arranged so as to move at half the traveling speed of the original illuminating unit 3. The mirror unit 6 is provided with second and third mirrors 7 and 8 for reflecting the original image light received from the illumination light source after being reflected by the original 1 and the first mirror 5.

The original image light reflected from the third mirror 8 passes through an image forming lens 9, and fixed mirrors 10, 11, and 12, so that it is formed into an image on the surface of a drum-shaped image carrier 13.

An IIT (Image Input Terminal) is constructed from the elements designated by the reference numerals 3 through 12.

An IOT (Image Output Terminal) disposed below the IIT (Image Input Terminal) will be described.

The image carrier 13 is arranged such that an electrostatic latent image is formed on the surface of the image carrier by the original image light formed into an image at a latent image write position Q1 while the image carrier is rotated.

An electrostatic electricity discharger 14 for evenly charging the surface of the image carrier 13 is disposed around the image carrier (a photosensitive drum) 13. Further, along the surface of the image carrier 13, at the downstream side of the latent image write position Q1, sequentially disposed are a red color processing unit (i.e., a red color developing unit) 15 for producing a toner image from the late image by development, a black color processing unit 16, a transfer unit 17 for transferring the toner image on the image carrier 13 to the paper at a transfer position Q2, and a toner cleaner unit 18 for wiping off the toner which was not transferred to the paper and is still remaining on the image carrier 13.

In FIG. 1, a fixing unit 19 for thermally fixing the toner image transferred to the paper is disposed in a leftward direction of the transfer position Q2. An unfixed paper transfer path 19 is provided between the transfer position Q2 and the fixing unit 19 for transferring an unfixed toner image.

The IOT has a paper feeding device H. The paper feeding device H has a plurality of paper feed trays 21 to 25 corresponding to the types of paper, a reverse tray 26 used in double-side copying operations, and a paper transport path 27 along which the paper received from each of the trays 21 to 25 is transported to the transfer position Q2 (i.e., the area between the transfer unit 17 and the image carrier 13). A plurality of paper transport rollers R are disposed along the paper transport path 27. In FIG. 2, the paper transport rollers R are made up of a drive roller R1 and a driven roller R2.

The fixing unit 19 is connected to a reverse transport path 28 for transporting the paper having the toner image (i.e., the fixing paper) to the reverse tray 26 after having reversed it, and a paper discharge path 29. A switch gate 30 is disposed at a branch point between the reverse transport path 28 and the paper discharge path 29. A discharge roller 31 is provided at the terminal of the paper discharge path 29 so as to discharge the paper to a discharge tray 32.

Rails 36 and 37 which extend from front to back (i.e., the x-axis direction) are provided along both sides of each of the paper feed trays 21 to 25 in the right-to-left direction (i.e., both sides of the paper feed tray in the Y-axis direction).

A roller 38 is rotatably supported on a lower side of a lower surface of the rail 37 provided on the right side of each of the paper feed trays 21 to 25, as shown in FIGS. 2 and 3. Upper part of the roller 38 projects upwardly from a hole formed in the lower surface of the rail 37. As in the right-side rail 37, the roller 38 (not shown) is also rotatably supported on the lower side of the lower surface of the left-side rail 36 of each of the trays 21 to 25.

In FIG. 1, guided rails 39 and 40 which are formed so as to bulge outside and extend from front to back are provided on lower part of both sides of each of the paper feed trays 21 to 25. The right-side guided rail 40 is supported on the upper surface of the roller 38 provided in the lower surface of the rail 37. Like the right-side guided rail 40, the guided rail 39 provided on the left side of each of the paper feed trays 21 to 25 is also supported on the upper surface of the roller 38 provided in the lower surface of the rail 36.

Each of the paper feed trays 21 to 25 is arranged so as to be movable in a forward direction (i.e., the X direction) along the rails 36 and 37.

As can be seen from FIG. 2, a paper loaded plate 45 on which the paper is loaded is laid on the top of a bottom plate 41 of each of the paper feed trays 21 to 25. The paper loaded plate 45 is at its left end supported by the inner bottom surface of each of the paper feed trays 21 to 25.

When the paper is fed and transported from the paper loaded plate 45, both edges of the paper in a transported direction are guided by a paper side edge positioning member 46, as shown in FIG. 2.

The front edge of each of the paper feed trays 21 to 25 in the paper feeding direction (i.e., the right-hand side edge of the paper in the drawing) is supported by a paper front edge support wall 47. On the other hand, the rear edge of the same in the paper feeding direction is supported by a paper rear edge support wall 48 (see FIG. 1). A lever through-hole 49 is formed in lower part of the paper front edge support wall 47, and a rotary shaft 50 for raising purposes is arranged outside the paper front edge support wall 47. The rotary shaft 50 is provided with a coupling (not shown) which is connected a shaft joined to the output shaft of a drive motor of a paper feed unit U1, as will be described later, via a reverse transmission one-way clutch (see FIG. 9) when the paper feed trays 21, 22, and 24 to 26 are inserted into the IOT. The rotary shaft 50 for raising purposes is rotated clockwise when the output shaft of the drive motor is reversely rotate, whereby the upper edge of the paper is retained in an appropriate position.

One end of an L-shaped raising lever 51 is fixed to the rotary shaft 50. The raising lever 51 having one end fixed to the rotary shaft 50 is at the other end brought into slidable contact with the lower surface of the paper loaded plate 45 through the lever through-hole 49.

The rotary shaft 50 is arranged so as to retain the upper edge of the paper in an appropriate position when it is rotated clockwise by the motor of the drive unit of the paper feed unit U1, which will be described later, via the reverse rotation transmission one-way clutch.

When no paper is loaded on the paper loaded plate 45, it is arranged so as to be raised to the upper limit position as represented by the upper paper feed tray 21 shown in FIG. 2.

A paper feed unit U1 is disposed on the right side of each of the paper feed trays 21 to 25 as a paper feeding device. The paper feed unit U1 is fixedly supported on the main frame (not shown) of the paper feeding device.

In FIG. 4, the paper feed unit U1 is provided with a unit frame 52. The unit frame 52 is provided with a front frame 53, a rectangular rear frame 54, and a joint frame 55 for connecting the front frame with the rear frame, and the like. The joint frame 55 supports a support (a supporting member) 56. The rectangular rear frame 54 is disposed outside (i.e., behind) the side of each of the paper feed trays 21 to 25 and the reverse tray 26 in the paper feeding direction (the rear side of the tray, that is, the side of the tray in the −X direction).

Paper guides 57 and 58 (see FIG. 3) are supported by the front frame 53 and the rectangular rear frame 54.

The rectangular rear frame 54 supports a drive unit (61 to 63) having a drive motor 61, a solenoid 62, a gear train 63, or the like, as shown in FIG. 4. The gear train 63 is constituted by a plurality of gears 63*a* to 63*c*, such as a gear 63*a* rotated by the drive motor 61 (see FIG. 4), a gear 63*b* which meshes with the gear 63*a*, and a gear 63*c* which meshes with the gear 63*b*. A one-way clutch (not shown) for forward rotation transmission purposes is interposed between the drive motor 61 and the gear 63*a*. The gear 63*a* rotates only when the drive motor 61 positively rotates.

A feed roller shaft 64 is rotatably supported by the rear frame 54 and the support 56. The feed roller shaft 64 is rotated by the drive motor 61 via the gear train 63. Feed rollers 65 made of synthetic rubber which has a high friction coefficient, high abrasion resistance, and high durability is fixedly attached to the feed roller shaft 64. The feed roller shaft 64 and the feed rollers 65 rotate in an integrated manner.

Rotating unit (61+63+64) for rotating the feed rollers 65 is constructed from the drive motor 61, the one-way clutch for forward rotation transmission purposes (not shown), the gear train 63, the feed roller shaft 64, or the like.

The right end of a pivotal arm 67 (i.e., the base end portion, or the side end portion of the −Y direction in FIG. 4) is rotatably supported on the feed roller shaft 64. The pivotal arm 67 is provided with a flat top plate and side plates downwardly extending from the side edges of the flat top plate. The left end of the pivotal arm 67 receives a downwardly rotating force by means of the action of gravity and a spring having a weak spring force (not shown). A lower surface of the rear end of the top plate of the pivotal arm 67 (i.e., the end of the top plate in the −X direction) is supported by an up-and-down lever 68 which acts as an arm position control member for controlling the downward pivotal movement of the pivotal arm. The up-and-down lever 68 is fixed to an arm up-and-down shaft 69 (see FIGS. 4 and 6). The arm up-and-down shaft 69 is rotatably supported at its rear end (the end in the −X direction) by the rear frame 54. The front end of the arm up-and-down shaft 69 is rotatably supported by the joint frame 55 via a -bracket (not shown).

A lever (not shown) which is joined to an extendable rod (not shown) of the solenoid 62 is fixed to the rear end of the arm up-and-down shaft 69 (i.e., the end of the arm up-and-down shaft in the −X direction). The arm up-and-down shaft 69 is arranged so as to rotate through only a predetermined angle as a result of the expansion and contraction of the solenoid 62. The arm up-and-down shaft 69 retains an up-and-down lever 68 in an elevated position when the solenoid 62 is in an OFF state. When the solenoid 62 is in an ON state, the arm up-and-down shaft 69 retains the up-and-down lever 68 in a lowered position. While the up-and-down lever 68 is retained in the lowered position, the pivotal arm 67 is arranged so as to downwardly pivot by means of the action of gravity and a spring having a weak spring force (not shown), as shown in FIG. 5.

A mechanism for bringing pickup rollers, which will be described later, into contact with or releasing them from the upper surface of the paper, that is, a pressing and releasing mechanism (67 to 69), is constructed from the elements designated by reference symbols 67 to 69.

A projecting leaf 67*a* for position control purposes extends from the pivotal arm 67 in the leftward direction (i.e., in the Y direction), as shown in FIGS. 4 and 5. This position control projecting leaf 67*a* vertically moves in accordance with the pivotal movement of the pivotal arm 67. A pivotal arm position sensor S, which is constructed from a light-emitting element Sa and a light-receiving element Sb and acts as a pick-up roller position sensor, is disposed such that the projecting leaf 67*a* is interposed between the light-emitting element and the light-receiving element in the front-to-back direction (i.e., in the X-axis direction).

When the pivotal arm 67 is lowered below a predetermined position through pivotal movement, the projecting leaf 67*a* is lowered between the light-emitting element Sa and the light-receiving element Sb. As a result, pivotal arm position sensor S changes from the OFF position to the ON position.

The pivotal arm position sensor is disposed so as to correspond to each of the paper feed trays 21 to 25.

A pickup roller shaft 71 which extends in the forward direction (i.e., in the X direction) is rotatably supported on the left end portion (i.e., the front end portion) of the pivotal arm 67. A pair of pickup rollers 72 and a gear 73 are fitted to the pickup roller shaft 71. The pickup rollers 72 are made of synthetic rubber which has a high friction coefficient, high abrasion resistance, and high durability.

The gear 73 meshes with a gear 75 fixed to the feed roller shaft 64 via a gear train 74 rotatably attached to the pivotal arm 67. Consequently, when the feed roller shaft 64 rotates, the feed rollers 65 and the gear 75 fitted to the feed roller shaft 64 rotate. Simultaneously, the gear 73 also rotates via the gear 75 and the gear train 74. When the gear 73 rotates, the pickup roller shaft 71 and the pickup rollers 72 rotate.

The pivotal arm 67, the gear train 74 supported by the pivotal arm 67, and the pickup rollers 72 is thin in the vertical direction. They are disposed between the bottom plate 41 of each of the paper feed trays 21, 24, and 25 and the upper end of the paper feed portion of each of the lower paper feed trays 22, 25, and 26 (i.e., the right-side portion of the tray or the portion of the tray in the (−Y) direction).

Similarly, the up-and-down lever 68 and the arm up-and-down shaft 69 are disposed in the space between the bottom plate 41 of each of the paper feed trays 21, 24, and 25 and the upper end of the paper feed portion of each of the lower paper feed trays 22, 25, and 26.

A retard roller shaft 76, retard rollers 77 and a gear 78 are disposed below the feed roller 65, as shown in FIG. 4. The retard rollers 77 and a gear 78 are fitted to the retard roller shaft 76. The retard rollers 77 are made of synthetic resin which has a high friction coefficient, high abrasion resistance, and high durability. They are fitted to a hub of the gear 78. The hub of the gear 78 is rotatably supported on the retard roller shaft 76 that is fixed to a pivotable support member 79 (see FIGS. 5 and 8) of the gear 78.

In the present embodiment, the feed rollers 65 and the retard rollers 77 have an outside diameter of ϕ15, and the rotary shafts 64 and 76 of these rollers are in line with each other. The pickup rollers 72 have an outside diameter of ϕ10 which is smaller than that of the rollers 65 and 77.

The pivotal support member 79 is given a rotating force centered around a pivot 81 by means of a tension spring 80 having one end joined to the joint frame 55, as shown in FIG. 5. The retard rollers 77 are pressed against the feed rollers 65 as a result of the action of the tension spring 80. Separately transporting rollers (65+77) of the present embodiment are constructed from the feed rollers 65 and the retard rollers 77.

The pivot 81 is unrotatably supported by the bracket 55*a* (see FIG. 7) provided on the joint frame 55 and the rear frame 54, as can be seen from FIGS. 3, 5, and 6. A torque limiter 82 which constitutes a retard roller braking unit is fitted around the pivot 81.

The torque limiter 82 is constituted by an output hub 83 fitted around the unrotative pivot 81, an input hub 84 disposed around the output hub 83, a magnet 85 fixed to the inner periphery of the input hub 84, and magnetic powder 86 contained between the magnet 85 and the output hub 83.

The input hub 84 is integrally joined to a gear 87 rotatably fitted around the pivot 81.

In the first embodiment, the rotation of the output hub 83 of the torque limiter 82 is prevented by the unrotatively supported pivot 81. That is, the unrotative pivot 81 constitutes an output element rotation suppressing unit for preventing the rotation of the output hub (the torque limiter output element) 83 in the first embodiment.

The pivotal support member 79 rotatably supports gears 88 and 89 which are in mesh with each other, and the gear 88 further meshes with the gear 87. The gear 89 meshes with the gear 78 attached to the retard roller shaft 76.

When the rotating force of the retard rollers 77 which are driven by the feed rollers 65 is transmitted to the input hub 84 of the torque limiter 82 via the gears 78, 88, and 89, the input hub 84 idles because the output hub 83 is unrotative. At this time, the input hub 84 and the output hub 83 move relative to each other while in frictional contact with the magnetic powder 86 provided between them. As a result, a braking force acts on the input hub 84.

In the first embodiment, the gear 87 also acts as a ganged rotary member (87) which rotates together with the rotation of the retard rollers 77. The torque limiter 82 is interposed between the gear (the ganged rotary member) 87 and the unrotative pivot (the fixing member) 81.

The function of the copier F provided with the paper feeder according to the first embodiment of the present invention will now be described.

In the copier F having the above-described features, the paper loaded plate 45 of each of the plurality of paper feed trays 21 to 25 stacked on top of each other in layers supports the lower surface of a stack of paper loaded in the tray in a raisable manner. Paper side edge positioning members 46 of each of the paper feed trays 21 to 25 guide the side edge of the stack of paper loaded in the tray. A paper front end support wall 47 and a paper rear end wall 48 (see FIG. 1) of each of the paper feed trays 21 to 25 respectively position and support the front and rear ends of the paper in the paper transportation direction.

The pickup rollers 72 are usually retained in a pickup roller elevated position (i.e., when the solenoid 62 is the OFF state). The paper feed trays 21 to 25 are supplied with paper while the pickup rollers 72 are retained in the elevated position, and the paper feed trays 21 to 25 are inserted into the copier F.

The solenoid 62 is turned on by means of a signal output from the control unit of the copier F at the time when the paper feed trays 21 to 25 containing the paper is inserted into the copier F. As a result, the pressing and releasing mechanism (67 to 69) moves the pickup rollers 72 down so as to be brought into contact with the upper surface of the paper. In this case, when the pickup rollers 72 are lowered to a predetermined position (i.e.,the pivotal arm position sensor S is turned on), the rotary shaft 50 for raising purposes is rotated via the reverse rotation transmission one-way clutch (not shown) by means of the reverse rotation of the drive motor 61, whereby the paper loaded plate 45 is raised. The paper loaded plate 45 continues to be raised until the pivotal arm position sensor S is turned off.

Subsequently, the solenoid 62 is turned off, and the pickup rollers 72 are retained in an elevated position.

When a copying operation is initiated in response to the operation of a user interface of the copier F, the drive motor 61 of the paper feed unit U1 corresponding to the paper tray that houses paper having a predetermined size is positively rotated. Simultaneously, the solenoid 62 is actuated. While the solenoid 62 is in the ON state, the pickup rollers 72 move to a lowered position (i.e., a paper take-out position) in which they are possible to come into contact with the paper on top of the selected one of the paper feed trays 21 to 25.

When the drive motor 61 is turned on so as to positively rotate, the pickup rollers 72 and the feed rollers 65 are rotated while the rotary shaft 50 for raising purposes joined to the drive motor 61 via the reverse rotation transmission one-way clutch (not shown) and the paper loaded plate 45 remain in a suspended state.

The pickup rollers 72 and the feed rollers 65 continue rotating while the drive motor 61 is positively rotating. The rotation and suspension of the feed rollers 65 and the pickup rollers 72 are repeated every time one sheet of paper is fed.

As a result of the on-off operations of the solenoid 62, the pickup rollers 72 are raised and lowered in synchronism with the rotation and suspension thereof carried out every time one sheet of paper is fed, whereby the pickup rollers 72 are repeatedly brought into contact with or released from the top sheet of paper loaded in the paper feed trays 21 to 25. The solenoid 62 is energized every time one sheet of paper is fed, so that a lever of the solenoid 62 joined to an extendable rod (not shown) is drawn. As a result, the arm up-and-down shaft 69 rotates, and the pivotal arm 67 becomes free. Then, the pickup rollers 72 are brought into contact with the top sheet of paper while they are rotating.

While being brought into contact with the top sheet of paper at an appropriate pressure, the pickup rollers 72 rotate in the paper feeding direction, whereby the paper is fed one after another to the nipping section between the feed rollers 65 and the retard rollers 77.

The retard rollers 77 rotate together with the rotation of the feed rollers 65 or the movement of the paper introduced into the nipping section. The rotation of the retard rollers 77 is transmitted to the input hub 84 of the torque limiter 82 via the gears 78, 89, 88, and 87. The magnetic powder (fine metallic particles) is interposed between the input hub 84 and the output hub 83 fixed to the unrotative pivot 81. Suitable frictional resistance is maintained between the magnetic powder 86 and the cylindrical magnet 85 provided along the inside of the input hub 84. As a result, the running torque within a certain limit is transmitted to the output hub 83. The running torque within the certain limit is absorbed by the deformation of the unrotative pivot 81.

The torque in excess of the certain limit is absorbed by the friction of the magnetic powder 86, or the like.

The energy absorbed by the friction of the magnetic powder 86, or the like, acts on the retard rollers 77 as a braking force.

If two sheets of paper are fed into the nipping section, the lower sheet of paper comes to a stop after the leading end of the paper has passed the nipping section somewhat, because the braking force acts on the retard rollers 77 which are driven by the feed rollers 65. As a result, only the top sheet of paper is transported. If more than three sheets of paper are fed into the nipping section, the middle sheet of paper comes to a stop due to a frictional force developed between that middle sheet of paper and a lower sheet of paper after the lower sheet of paper has stopped.

In this way, the paper introduced into the nipping section is separated sheet by sheet.

A copying operation is carried out while the paper is fed by rotating the pickup rollers 72 using the drive motor 61. After a plurality of sheets of paper have been fed, the position of the upper surface of the paper is lowered, as a result of which the pivotal arm position sensor S is turned on. Then, the rotary shaft 50 for raising purposes is rotated by reversely rotating the drive motor 61 by only a certain amount, whereby the paper loaded plate 45 is raised. The rotational position of the rotary shaft 50 is controlled so that the pivotal arm position sensor S is constantly in the OFF state.

Namely, the rotary shaft 50 (see FIGS. 2 and 3) and the raising lever 51 rotate via the reverse rotation transmission one-way clutch (not shown) by reversely rotating the drive motor 61. The paper loaded plate 45 is raised by the raising lever 51. The paper loaded plate 45 raises a batch of paper at an angle with one end of the paper facing the pickup rollers 72 that is in a wait state at an elevated position. At this time, the upper surface of the paper comes into contact with the lower side of the pickup rollers 72, so that the pickup rollers 72 are raised. The pickup rollers 72 attached to the pivotal arm 67 which is pivotable on the axis of the feed rollers 65 are raised together with the paper. When the pivotal arm position sensor S is turned off, the reverse rotation of the drive motor 61 is stopped. In that position, the paper is removed.

The paper separated into a single sheet by the pickup rollers 72, the feed rollers 65, and the retard rollers 77, all of which have a high frictional coefficient and high abrasion resistance, is transported downstream.

The height of the top sheet of paper is gradually reduced as the paper feeding operations proceed. The height of the pickup rollers 72 and the pivotal arm 67 become reduced accordingly. In the end; the previously described pivotal arm position sensor S is turned on. The paper loaded plate 45 is raised to a predetermined minute height by rotating the drive motor by a predetermined amount on the basis of the ON signal, and the paper feeding operations are resumed. It is possible to feed all of the paper loaded in the paper feed trays 21 to 25 through repetition of the above described operations.

The paper that is fed by the pickup rollers 72 and is separated into a single sheet by the feed rollers 65 and the retard rollers 77 is transported to the paper transport path 27 on the opposite side with respect to the paper feed trays 21 to 25 of the paper feed unit U1 (i.e., on the right side of the paper feed trays). The paper is transported further downstream (or in an upward direction) to the transfer position Q2 (see FIG. 1) by means of a plurality of paper transport rollers R disposed along the paper transport path 27.

Second Embodiment

A paper feeder according to a second embodiment of the present invention will now be described with reference to FIGS. 8 and 9.

Figure 8:
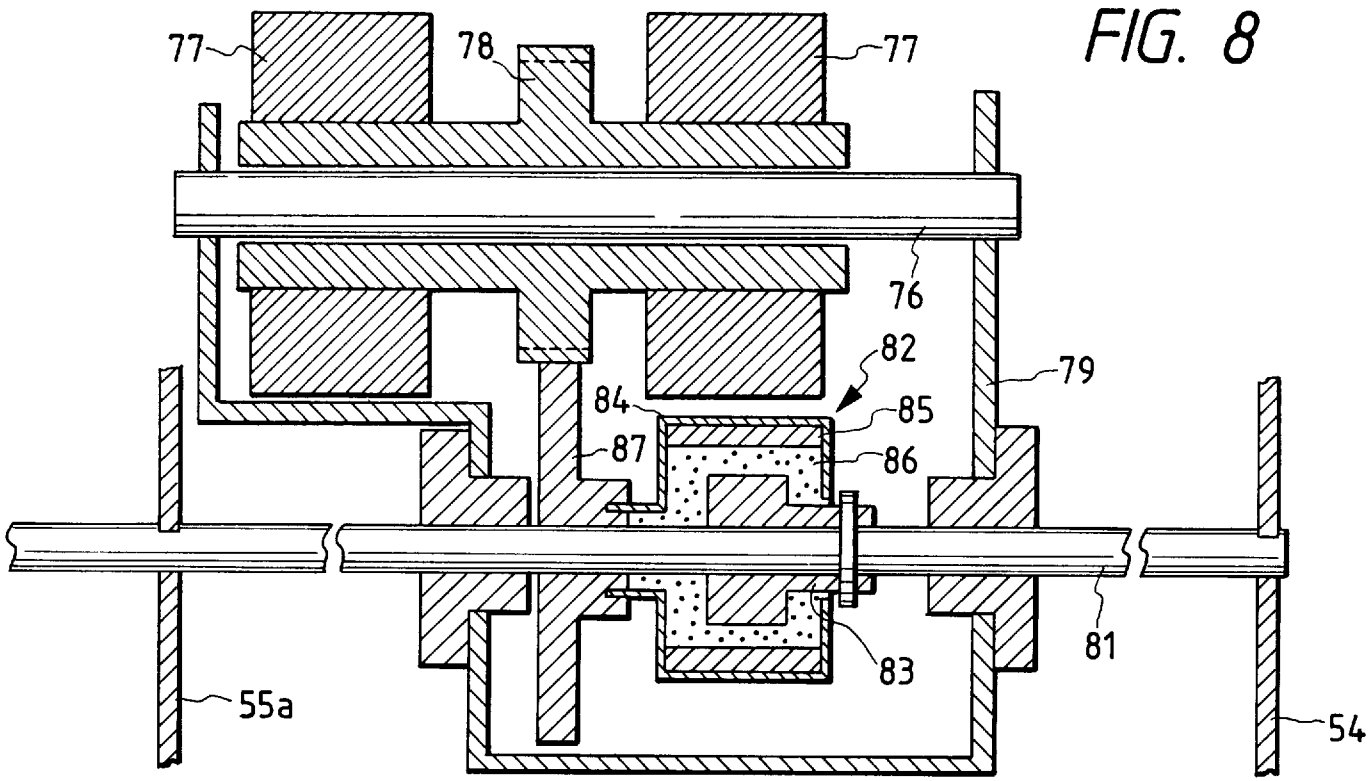
FIG. 8 is an explanatory illustration of a retard roller supporting structure of the paper feeder of a second embodiment of the present invention, and this illustration corresponds to FIG. 7 which shows the first embodiment.
Figure 9:
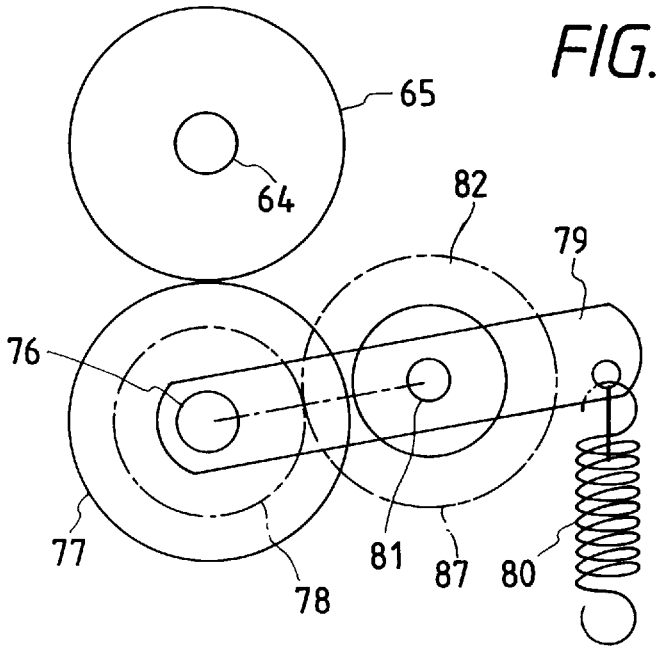
FIG. 9 is a side elevation view of the retard roller supporting structure of the second embodiment.

FIG. 8 is an illustration of the structure for supporting retard rollers of the paper feeder according to the second embodiment of the present invention. FIG. 8 corresponds to FIG. 7 of the first embodiment. FIG. 9 is a side view of the structure for supporting the retard rollers of the second embodiment.

In the descriptions of the second embodiment, the elements corresponding to the constituent elements of the first embodiment are assigned the same reference numerals, and their detailed explanation will be omitted here.

The second embodiment is the same as the first embodiment, except for the following point:

The gears 88 and 89 of the first embodiment shown in FIG. 7 are omitted from the paper feeder of the second embodiment. The gears 78 and 87 are arranged so as to directly mesh with each other.

The second embodiment yields the same effect as that obtained by the first embodiment.

Third Embodiment

Figure 11:
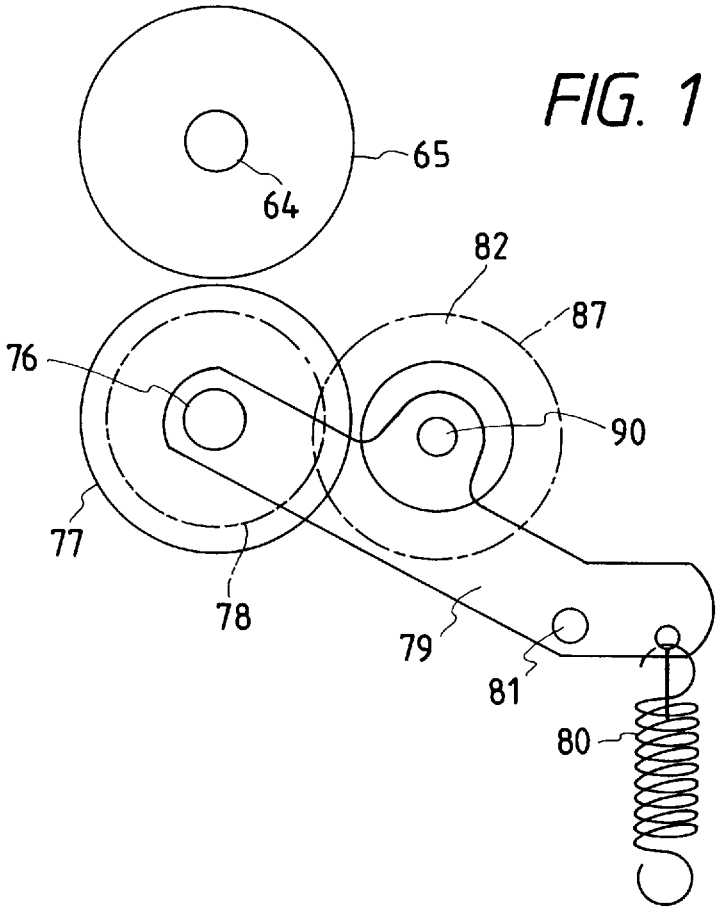
FIG. 11 is a side elevation view of the retard roller supporting structure of the third embodiment.

A paper feeder according to a third embodiment of the present invention will now be described with reference to FIGS. 10 and 11.

Figure 10:
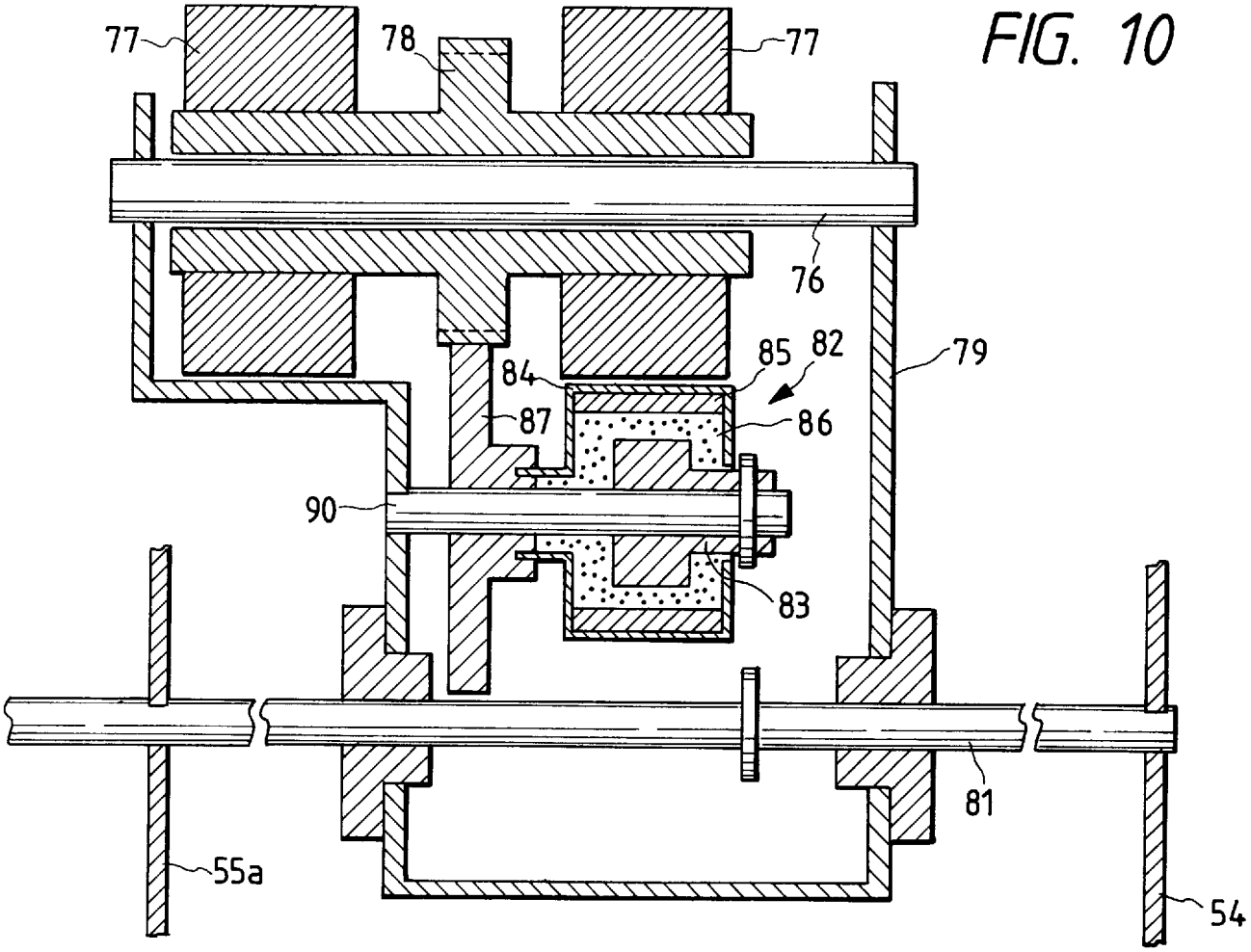
FIG. 10 is an explanatory illustration of a retard roller supporting structure of the paper feeder of a third embodiment of the present invention, and this illustration corresponds to FIG. 7 which shows the first embodiment.

FIG. 10 is an illustration of the structure for supporting retard rollers of the paper feeder according to the third embodiment of the present invention. FIG. 10 corresponds to FIG. 7 of the first embodiment. FIG. 11 is a side view of the structure for supporting the retard rollers of the third embodiment.

In the descriptions of the third embodiment, the elements corresponding to the constituent elements of the first embodiment are assigned the same reference numerals, and their detailed explanation will be omitted here.

The third embodiment is the same as the first embodiment, except for the following point:

The gears 88 and 89 of the first embodiment shown in FIG. 7 are omitted from the paper feeder of the third embodiment. Instead of them, the paper feeder is provided with a fixed shaft 90. The torque limiter 82 and the gear 87 are not fitted to the pivot 81 but fitted to the fixed shaft 90.

The third embodiment yields the same effect as that obtained by the first and second embodiments.

Fourth Embodiment

A paper feeder according to a fourth embodiment of the present invention will now be described with reference to FIGS. 12 to 16.

Figure 12:
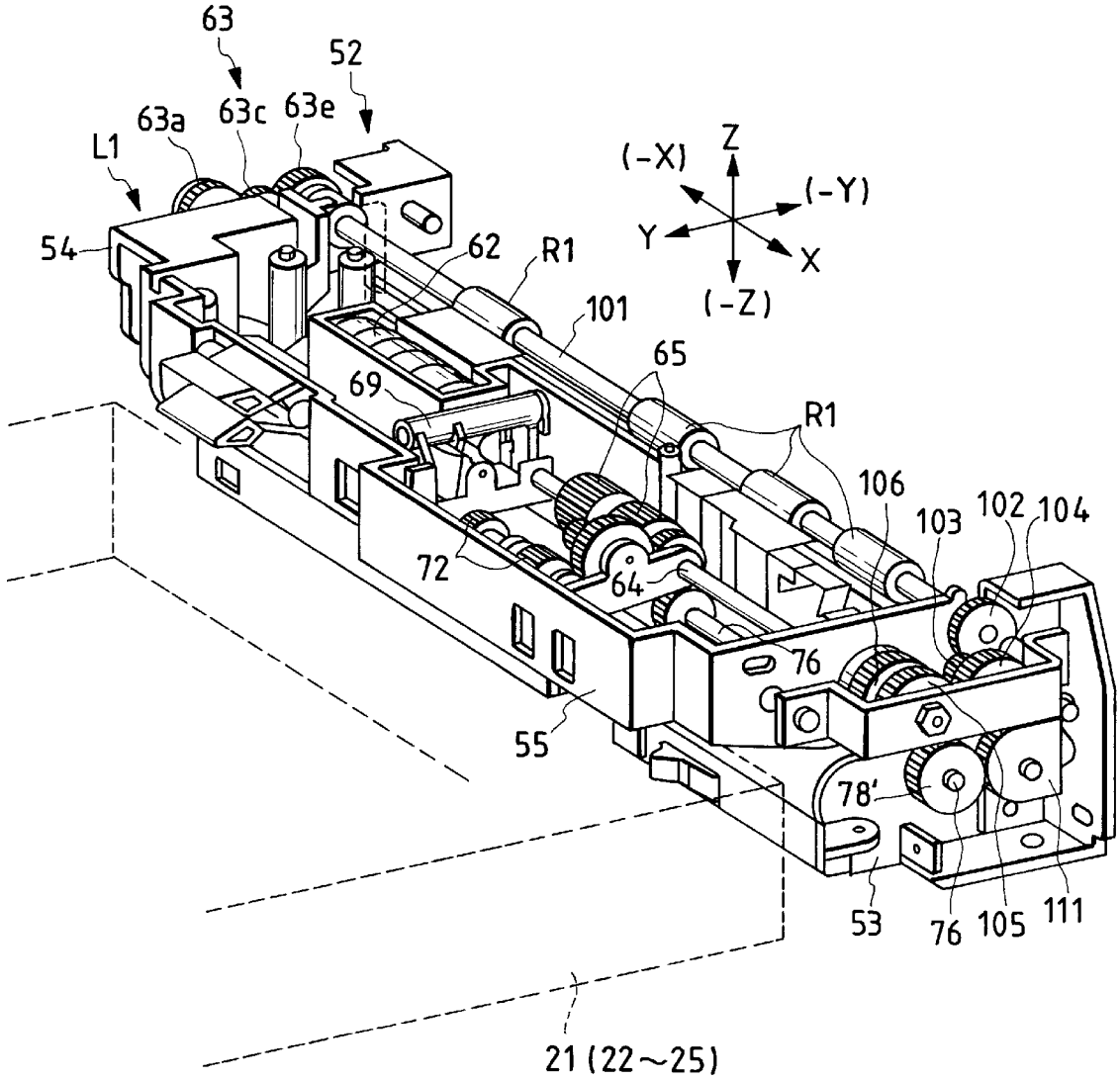
FIG. 12 is a perspective view of a paper feeder according to a fourth embodiment of the present invention, and this drawing corresponds to FIG. 4 which shows the first embodiment.
Figure 13:
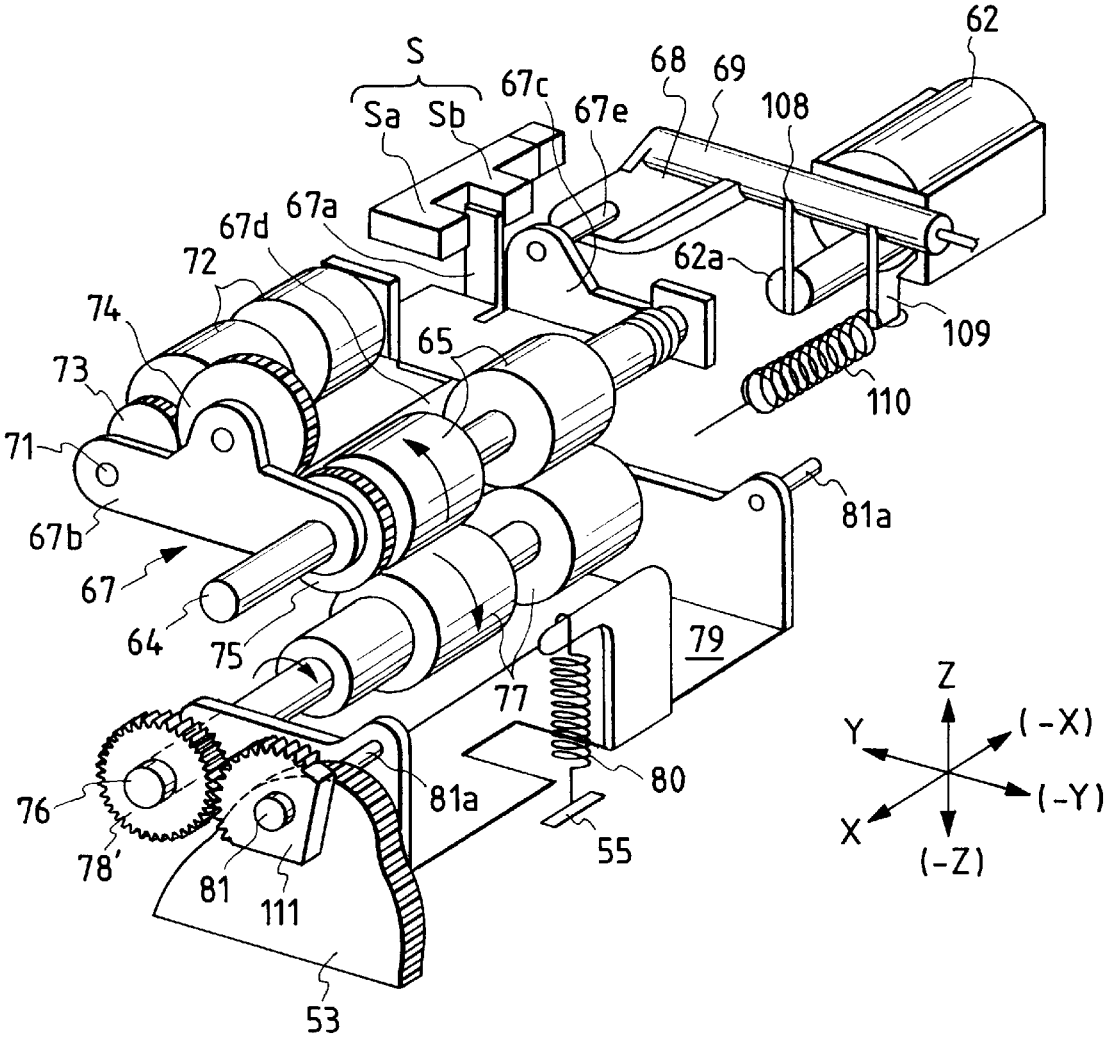
FIG. 13 is a perspective view of the principle elements of the fourth embodiment which shows the mechanism to press the retard rollers against the feed rollers.
Figure 14:
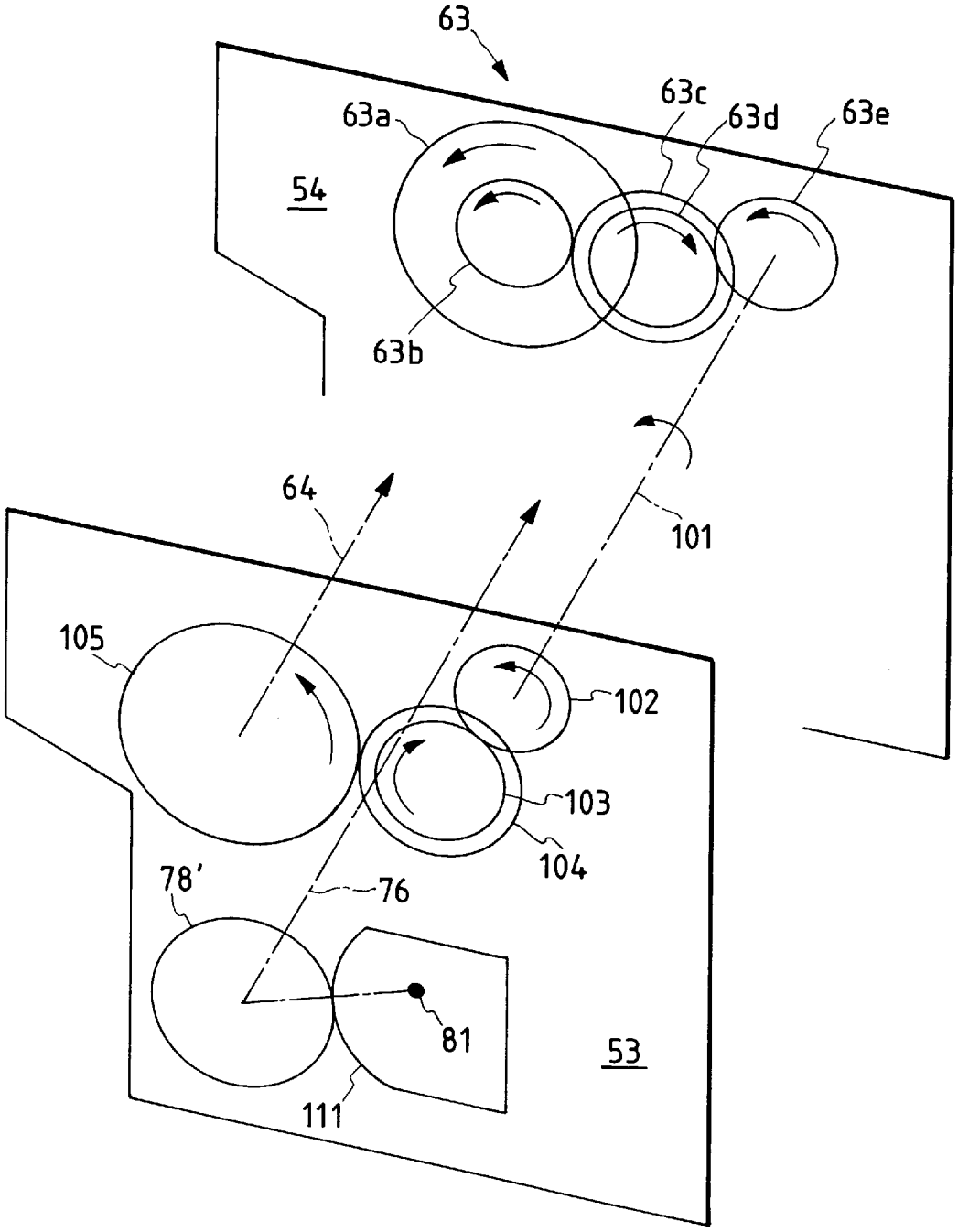
FIG. 14 is an explanatory illustration of a power transmission mechanism of the paper feeder of the fourth embodiment.
Figure 15:
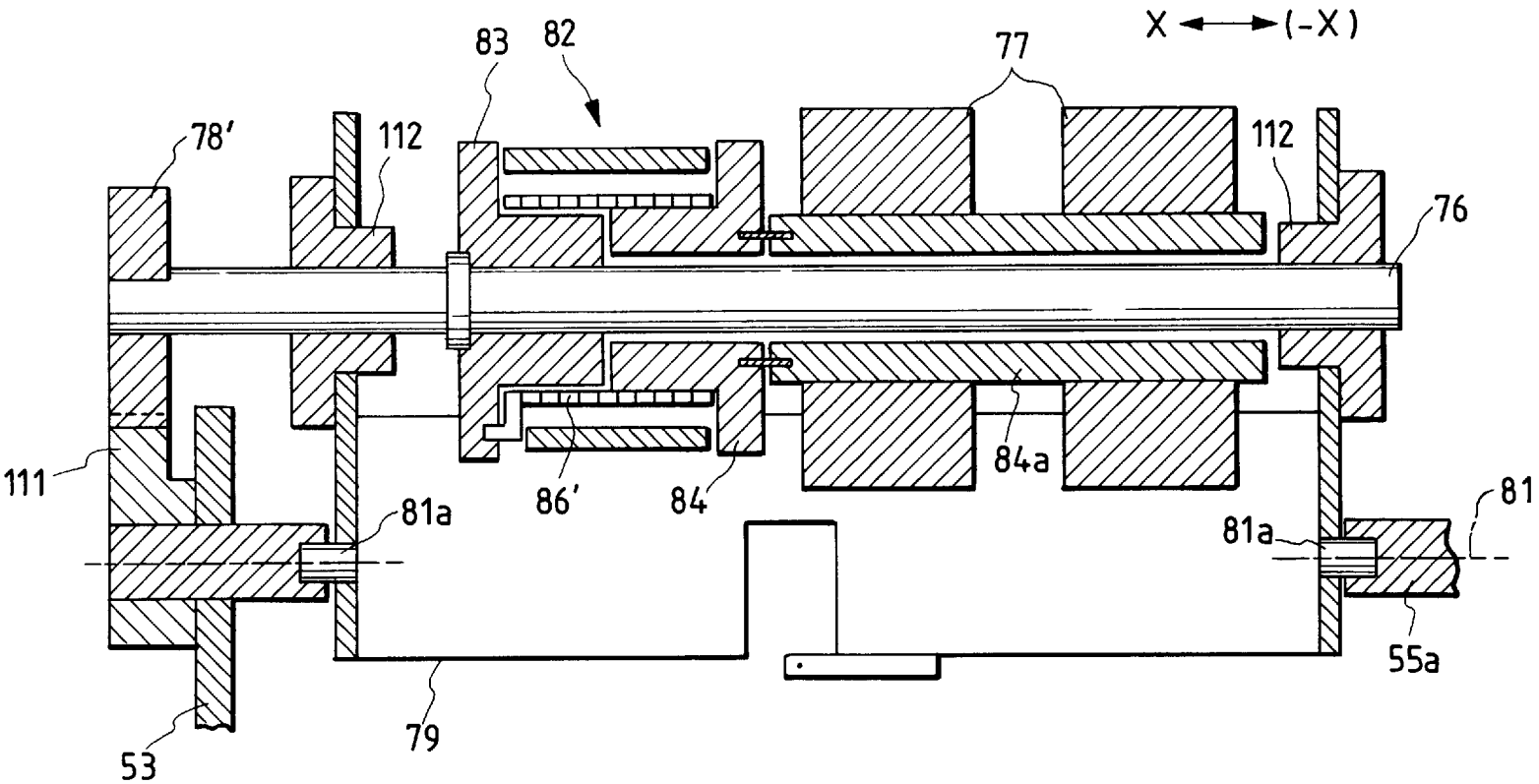
FIG. 15 is an explanatory illustration of retard roller braking unit of the paper feeder of the fourth embodiment.
Figure 16:
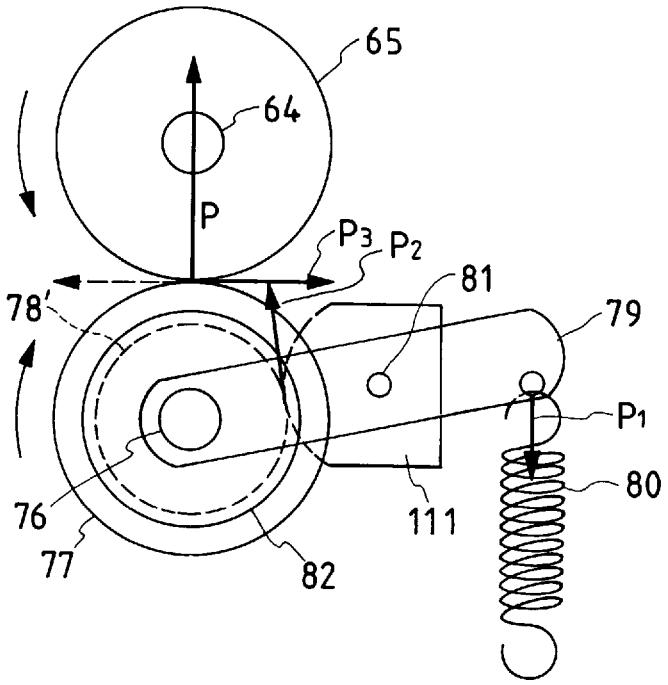
FIG. 16 is an explanatory illustration showing the operation of the pressing force increasing unit used in the fourth embodiment.

FIG. 12 is a perspective view of a paper feeder according to a fourth embodiment of the present invention. FIG. 13 is a perspective view of the principle elements of the paper feeder of the fourth embodiment of the present invention. FIG. 14 is an illustration of a power transmission mechanism of the paper feeder of the fourth embodiment. FIG. 15 is an illustration of retard roller braking unit of the paper feeder of the fourth embodiment. FIG. 16 is an illustration for explaining the operation of pressing force increasing unit used in the paper feeder of the fourth embodiment.

In the descriptions of the fourth embodiment, the elements corresponding to the constituent elements of the first embodiment are assigned the same reference numerals, and their detailed explanation will be omitted here.

The fourth embodiment is the same as the first embodiment, except for the following points:

As shown in FIGS. 12 and 13, the paper feed unit U1 of the fourth embodiment which serves as the paper feeder incorporates drive rollers R1 which form the transport rollers R of the first embodiment shown in FIG. 2.

The paper feed unit U1 is provided with a unit frame 52. The unit frame 52 is equipped with the front frame 53, the rectangular rear frame 54, and the joint frame 55 which connects the front frame 53 with the rear frame 54.

The rectangular rear frame 54 supports a drive unit consisting of a drive motor (not shown), a gear train 63 (see FIGS. 12 and 14), or the like. As shown in FIG. 14, the gear train 63 is constituted by a gear 63*a* rotated by the drive motor (not shown), and a plurality of gears 63*a* to 63*e* which mesh with the gear 63*a* in turn.

As shown in FIG. 12, a transport drive roller shaft 101 is rotatably supported by a front frame 53 and a rear frame 54. The gear 63*e* is fixed to the rear end of the transport drive roller shaft 101. A gear 102 is fixed to the front end of the transport drive roller shaft 101, whereby the gear 63*e*, the transport drive roller shaft 101, and the gear 102 rotate in an integrated fashion.

The front frame 53 supports gears 103 to 105 which mesh with the gear 102 in turn, as shown in FIGS. 12 and 14.

The gear 105 is supported by the feed roller shaft 64 via a clutch 106. This feed roller shaft 64 is rotatably supported by the front frame 53 and the joint frame 55.

The feed rollers 65 and the gear 75 are fixed to the feed roller shaft 64, as shown in FIG. 13, and they are arranged to constantly rotate. The pivotal arm 67 is rotatably supported by the feed roller shaft 64. Namely, when the gear 63*e* (see FIGS. 12 and 14) rotates, the rotating force of the gear 63*e* is transmitted to the transport drive roller shaft 101 and the gears 102 to 105. When the clutch 106 (see FIG. 12) is in the ON state, the feed roller shaft 64, the feed rollers 65, and the gear 75 rotate together with the gear 105 in an integrated fashion. The clutch 106 is arranged so as to repeat on-off operations every time one sheet of paper is fed.

The pivotal arm 67 pivotally supported by the feed roller shaft 64 has a position control projecting leaf 67*a*, as shown in FIG. 13. Side walls 67*b* and 67*c* are provided on both sides of the pivotal arm 67 in the front-to-back direction (i.e., in the X-axis direction). The pivotal arm 67 is further provided with a plate-like narrow joint 67*d* which connects together the side walls 67*b* and 67*c*.

The right end portions of the side walls 67*b* and 67*c* of the pivotal arm 67 (the base portions, or the end portions of the side walls in the (−Y) direction in FIG. 13) are rotatably supported by the feed roller shaft 64.

The left end portion of the pivotal arm 67 receives a downwardly rotating force by means of the action of gravity and a spring having a spring weak force (not shown). The lower surface of a pin 67*e* rearwardly projecting from the side wall 67*c* provided on the rear side of the pivotal arm 67 is supported by the up-and-down lever 68 that acts as the arm position control member for controlling the downward rotation of the pivotal arm 67. The up-and-down lever 68 is fitted to the arm up-and-down shaft 69 (see FIG. 13) that extends from left to right (i.e., in the Y-axis direction). Though not shown in the drawing, the arm up-and-down shaft 69 is rotatably supported by the joint frame 55. An operation joint rod 108 and a spring joint rod 109 are fixed to the arm up-and-down shaft 69 so as to downwardly extend. The lower end of the operation joint rod 108 is joined to the leading end of the extendable rod 62*a* of the solenoid 62 so as to be relatively rotatable as well as to be relatively movable in a vertical direction.

The lower end of the spring joint rod 109 is connected to a tension spring 110. As a result of the lower end of the spring joint rod 109 being drawn in the forward direction (i.e., in the X direction) by means of the tension spring 110, the arm up-and-down shaft 69 and the operation joint rod 108 rotate, whereby the extendable rod 62*a* extends.

When the extendable rod 62*a* contracts as a result of the solenoid 62 being turned on, the operation joint rod 108, the arm up-and-down shaft 69, and the spring joint rod 109 rotate. When the solenoid 62 is in the OFF state, the up-and-down lever 68 and the pin 67*e* of the pivotal arm 67 are retained in an elevated position by the tension spring 110. On the other hand, when the solenoid 62 is in the ON state, the up-and-down lever 68 is retained in a lowered position.

The pivotal arm 67 downwardly pivots by means of gravity and the spring (not shown) while the up-and-down lever 68 is retained in the lowered position, as shown in FIG. 13.

The solenoid 62 is energized and, eventually, turned on every time one sheet of paper is fed. At this time, the pivotal arm 67 is lowered, and the pickup rollers 72 come into contact with the paper while rotating.

The pivotal arm 67 rotatably supports at its left end (i.e., at the front end portion or at the end portion in the Y direction) the pickup roller shaft 71 that extends in the front-to-back direction (i.e., the X-axis direction). The pickup rollers 72 and the gear 73 are fitted around the pickup roller shaft 71.

The pivotal arm position sensor S for detecting the height of the paper is turned off when the pickup rollers 72 are situated in or above the paper take-out position that is set slightly below the elevated position of the pickup rollers 72. When the pickup rollers 72 are lowered below the paper take-out position, the pivotal arm position sensor S is turned on. The paper is fed only when the pivotal arm position sensor S is in the OFF state.

The gear 73 is in mesh with the gear 75 fitted to the feed roller shaft 64 via the idler gear 74 rotatably attached to the pivotal arm 67. As a result, when the feed roller shaft 64 rotates, the feed rollers 65 and the gear 75 fitted to the feed roller shaft 64 rotate. Simultaneously, the gear 73 rotates via the gear 75 and the idler gear 74. As a result of the rotation of the gear 73, the pickup roller shaft 71 and the pickup rollers 72 rotate.

The retard roller shaft 76 is positioned below the feed rollers 65, as shown in FIGS. 12 to 14.

The pivotal support member 79 that supports the retard roller shaft 76 is provided with a pair of pins 81*a*, 81*a* which form the pivot 81, as shown in FIGS. 13 and 15.

The pins 81*a*, 81*a* that form the pivot 81 are rotatably supported by the bracket 55*a* (see FIG. 11) and the front frame 53 provided on the joint frame 55. A fixed gear 111 centered on the pivot 81 is fixed to the front frame 53.

The retard roller shaft 76 is rotatably supported by the pivotal support member 79 via bearings 112, 112 (see FIG. 15).

The pressing gear 78' is fixed to the front end of the retard roller shaft 76. The pressing gear 78' is in mesh with the fixed gear 111.

The pivotal support member 79 is given a rotating force centered around the pivot 81 by means of the tension spring 80 having one end connected to the joint frame 55, as shown in FIG. 13. The retard rollers 77 are pressed against the feed rollers 65 by the action of the tension spring 80. The feed rollers 65 and the retard rollers 77 constitute the separately transporting roller (65+77) of the present embodiment.

The torque limiter 82 is constituted by the output hub 83 fitted to the retard roller shaft 76, and the input hub 84 which is rotatably fitted around the retard roller shaft 76 so as to be opposite to the output hub 83. The retard rollers 77 are fitted around the cylindrical member 84*a* integrally joined to the input hub 84.

The input hub 84 and the output hub 83 are joined together by a wrap spring 86' so that running torque less than a predetermined value can be transmitted.

If the rotating force of the retard rollers 77 which are brought into contact with and driven by the feed rollers 65 is transmitted to the input hub 84 of the torque limiter 82, predetermined running torque is transmitted to the output hub 83. The running torque in excess of the predetermined value is absorbed as a result of the input hub 84 idling with respect to the output hub 83. In this case, the wrap spring 86' provided between the input hub 84 and the output hub 83 moves while it is in frictional contact with the input hub 84. As a result, a braking force acts on the input hub 84.

When the output hub 83 rotates, the retard roller shaft 76 and the pressing gear 78' rotate in an integrated fashion. The pressing gear 78' which rotates together with the output hub 83 in an integrated fashion is in mesh with the fixed gear 111, and hence it cannot rotate freely. Namely, the pressing gear 78' rotates along the fixed gear 111. As can be seen from FIG. 13, the retard roller shaft 76 rotates when the pressing gear 78' rotates. Hence, the pivotal support member 79 pivots on the pivot 81. The retard rollers 77 are pressed against the feed rollers 65 so that the pressing force exerted on the feed rollers 65 from the retard rollers 77, that is, a retarding pressure, increases.

In the fourth embodiment, the free rotation of the output hub 83 of the torque limiter 82 is prevented by the fixed gear 111. In other words, the fixed gear 111 forms output element rotation suppressing unit (111) for preventing the rotation of the output hub (the output element of the torque limiter) 83 in the fourth embodiment.

Further, the elements designated by reference symbols 78', 79, 81, and 111 form pressing force increasing unit (78'+79+81+111) which increases the pressing force (i.e., the retarding pressure) exerted on the feed rollers 65 from the retard rollers 77.

The function of the paper feeder having the previously described elements according to the fourth embodiment of the present invention will be described.

FIG. 16 is an illustration for explaining the operation of the paper feeder of the fourth embodiment shown in FIGS. 12 to 15. Arrows P1 to P3 shown in FIG. 16 designate the following forces:

P1: the tensile force of the tension spring 80 (a tensile force P1 of the tension spring 80 acts on the pivotal support member 79, and the retard rollers 77 supported on the leading end of the pivotal support member 79 are pressed against the feed rollers 65), P2: an upward force which the pressing gear 78' receives from the fixed gear 111 through a meshed section between them in reaction to the force transmitted by the torque limiter 82, and P3: a pulling force which the retard rollers 77 receive from the feed rollers 65 in the nipping section between them in reaction to the braking force developed in the torque limiter 82.

In the fourth embodiment, the braking force acts on the input hub 84 by means of the torque limiter 82. For this reason, if the feed roller 65 transports a plurality of sheets of paper to enter the nipping section between the feed rollers 65 and the retard rollers 77, the braking force acts on the bottom sheet of paper in contact with the retard rollers 77. The top sheet of paper is separated from the lower sheets of paper by means of the braking force, and the thus separated top sheet of paper is transported. The braking force acts in the same way as in the paper feeder of the first embodiment.

Based on the assumption that distances between the center of the pivot 81 and action lines of the forces P1, P2, and P3 are L1, L2, and L3, respectively, the sum of angular moments of the forces P1, P2, and P3 center on the pivot 81 in the case of the paper feeder as shown in FIG. 12 can be expressed by the following expression:

$$P1 \times L1 + P2 \times L2 + P3 \times L3.$$

Provided that the force (i.e., the retarding pressure) by which the retard rollers 77 are pressed against the feed rollers 65 by means of the angular moments is P, and that the distance between the action line of the retarding pressure P and the center of the pivot 81 is L, the retarding pressure P can be expressed by the following expression.

$$P = (P1 \times L1 + P2 \times L2 + P3 \times L3)/L$$

The braking force that acts on the paper introduced into the nipping section between the feed rollers 65 and the retard rollers 77 can be expressed by the following expression, provided that a coefficient of friction between the retard rollers 77 and the paper is micrometer.

Braking force acting on the paper=P×$\mu$

Therefore, the braking force that acts on the paper becomes larger as the value of P increases. Consequently, the function of separating a plurality of sheets of paper introduced in the nipping section is enhanced.

In the fourth embodiment, the paper has already moved in the direction in which it is transported the moment when it enters the nipping section between the feed rollers 65 and the retard rollers 77. The retard rollers 77 are rotated together with the movement of the paper. At this time, the pressing gear 78' tries to rotate, whereby a large value of P2 is obtained as a result of receipt of reaction from the fixed gear 111.

In other words, the value of P2 is large the moment when the paper enters the nipping section, and therefore the value of P is large. For this reason, it is possible to apply the large braking force (P×$\mu$) to the paper the moment when it enters the nipping section. As a result, it is possible to obtain a paper feeder having an improved function of separating a plurality of sheets of paper introduced to the nipping section in the fourth embodiment.

Fifth Embodiment

A paper feeder according to a fifth embodiment of the present invention will now be described with reference to FIG. 17.

Figure 17:
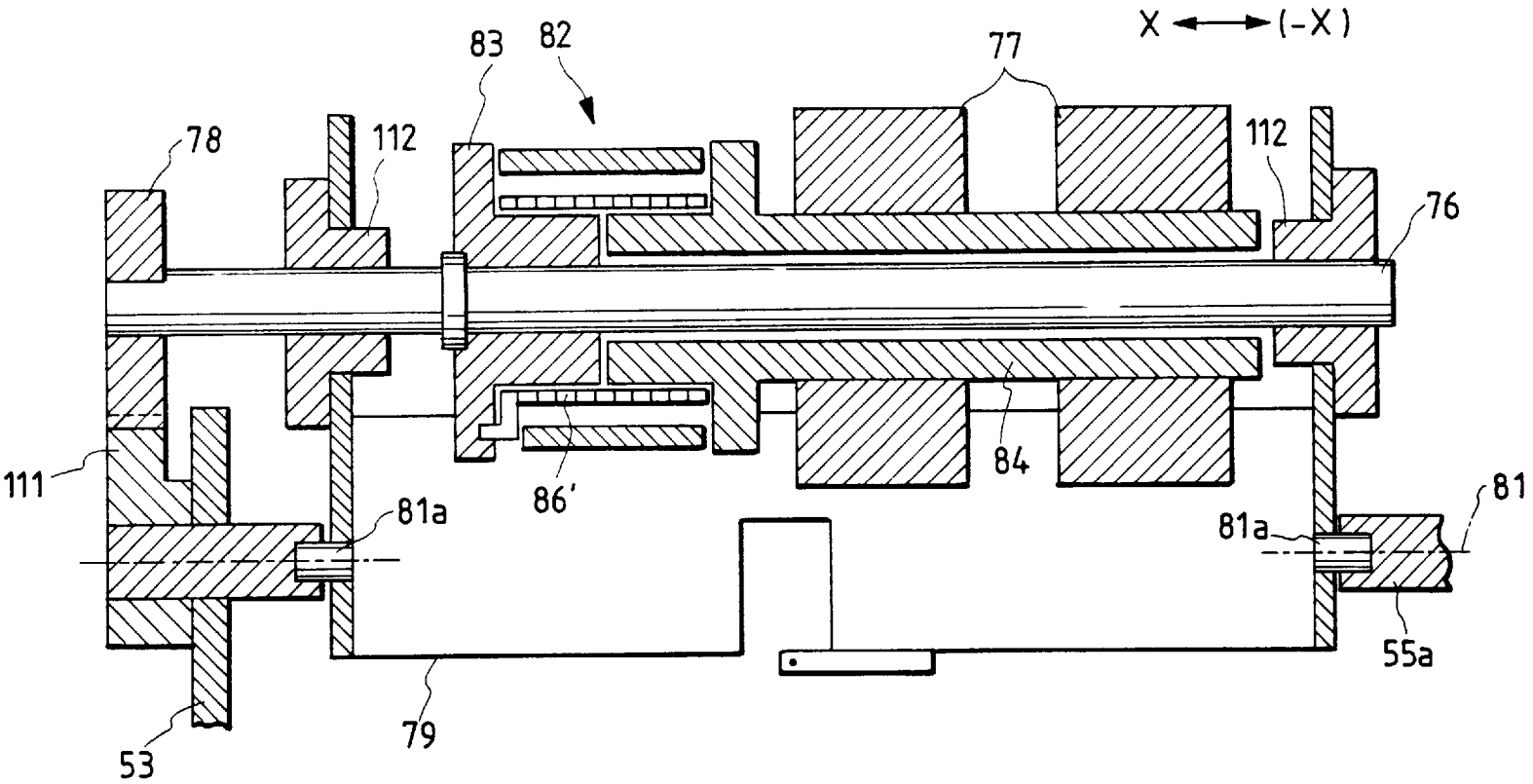
FIG. 17 is an explanatory illustration of the structure of a retard roller supporting mechanism of a paper feeder according to a fifth embodiment of the present invention, and this illustration corresponds to FIG. 15 which shows the fourth embodiment.

FIG. 17 is an explanatory illustration of the structure for supporting the retard rollers of the paper feeder of the fifth embodiment. FIG. 17 corresponds to FIG. 15 that illustrates the paper feeder of the fourth embodiment.

The fifth embodiment is different from the fourth embodiment in that the input hub 84 and the cylindrical member 84*a* integrally joined together in the fourth embodiment shown in FIG. 15 are manufactured in an integrated fashion, as shown in FIG. 17.

The paper feeder of the fifth embodiment operates in the same manner as the paper feeder of the fourth embodiment.

Sixth Embodiment

A paper feeder of a sixth embodiment of the present invention will now be described with reference to FIGS. 18 and 19.

Figure 18:
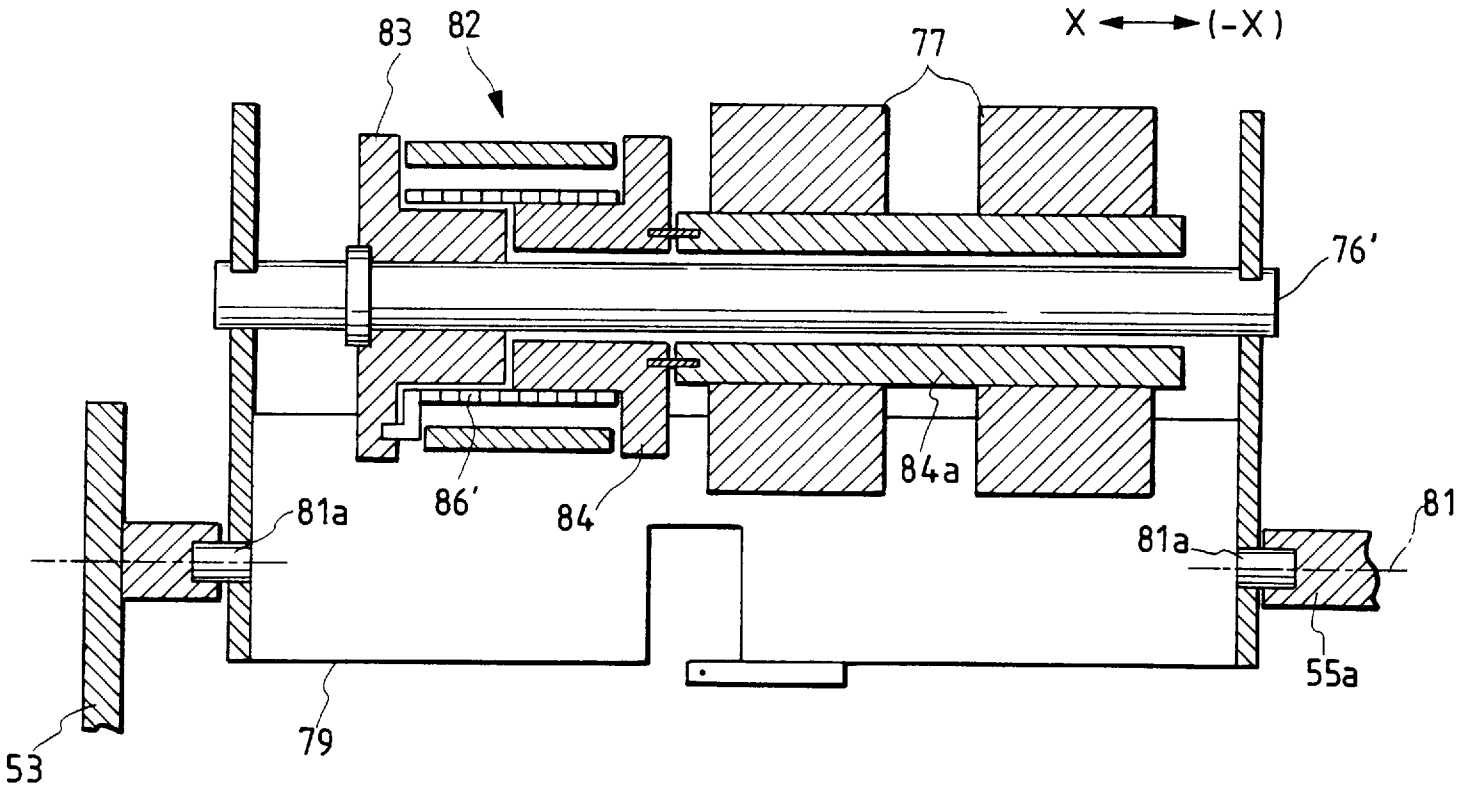
FIG. 18 is an explanatory illustration of the structure of a retard roller supporting mechanism of a paper feeder according to a sixth embodiment of the present invention, and this illustration corresponds to FIG. 15 which shows the fourth embodiment.

FIG. 18 is an explanatory illustration of the structure for supporting the retard rollers of the paper feeder of the sixth embodiment.

FIG. 18 corresponds to FIG. 15 that shows the paper feeder of the fourth embodiment. FIG. 19 is a side view of the structure for supporting the retard rollers of the paper feeder of the sixth embodiment.

In the descriptions of the sixth embodiment, the constituent elements which are the same as those of the fourth embodiment are assigned the same reference numerals, and their detailed descriptions will be omitted here.

The paper feeder of the sixth embodiment is different from the paper feeder of the fourth embodiment in only the following point:

That is, the pressing gear 78' and the fixed gear 111 of the paper feeder of the fourth embodiment shown in FIG. 15 are omitted from the paper feeder of the sixth embodiment. Further, an unrotational retard roller support shaft 76' fixed to the pivotal support member 79 is used in lieu of the rotatable retard roller shaft 76.

Figure 19:
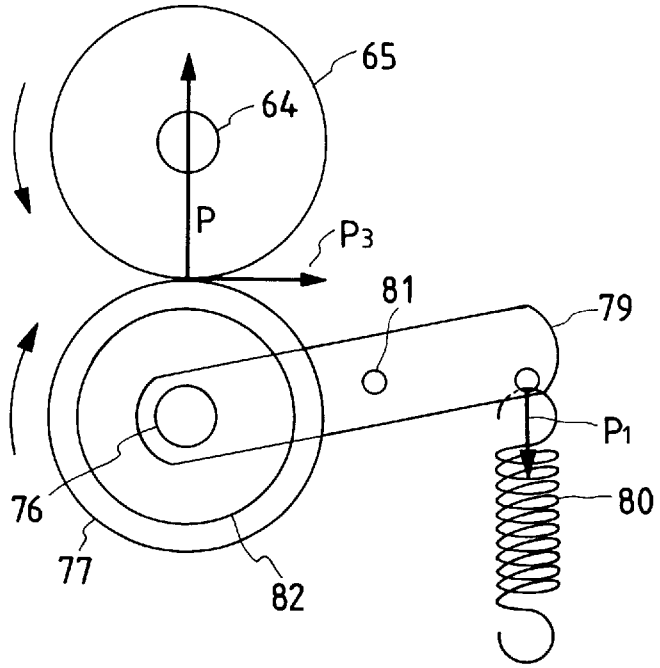
FIG. 19 is a side view of the retard roller supporting structure of the sixth embodiment of the present invention.

In the sixth embodiment, the force P2 of the fourth embodiment shown in FIG. 16 is not generated, as shown in FIG. 19. In other words, in contrast with the fifth embodiment, it is not necessary to increase the braking force acting on the paper by increasing the pressing force (i.e., the retarding pressure) P when the paper enters the nipping section between the feed rollers 65 and the retard rollers 77 in the sixth embodiment.

In the sixth embodiment, the braking force acting on the retard rollers 77 is exerted on the paper introduced into the nipping section by means of the torque limiter 82. As a result, the paper is separated. In view of this point, the paper feeder of the sixth embodiment operates in the same manner as the paper feeders of the first to third embodiments.

Seventh Embodiment

Figure 20:
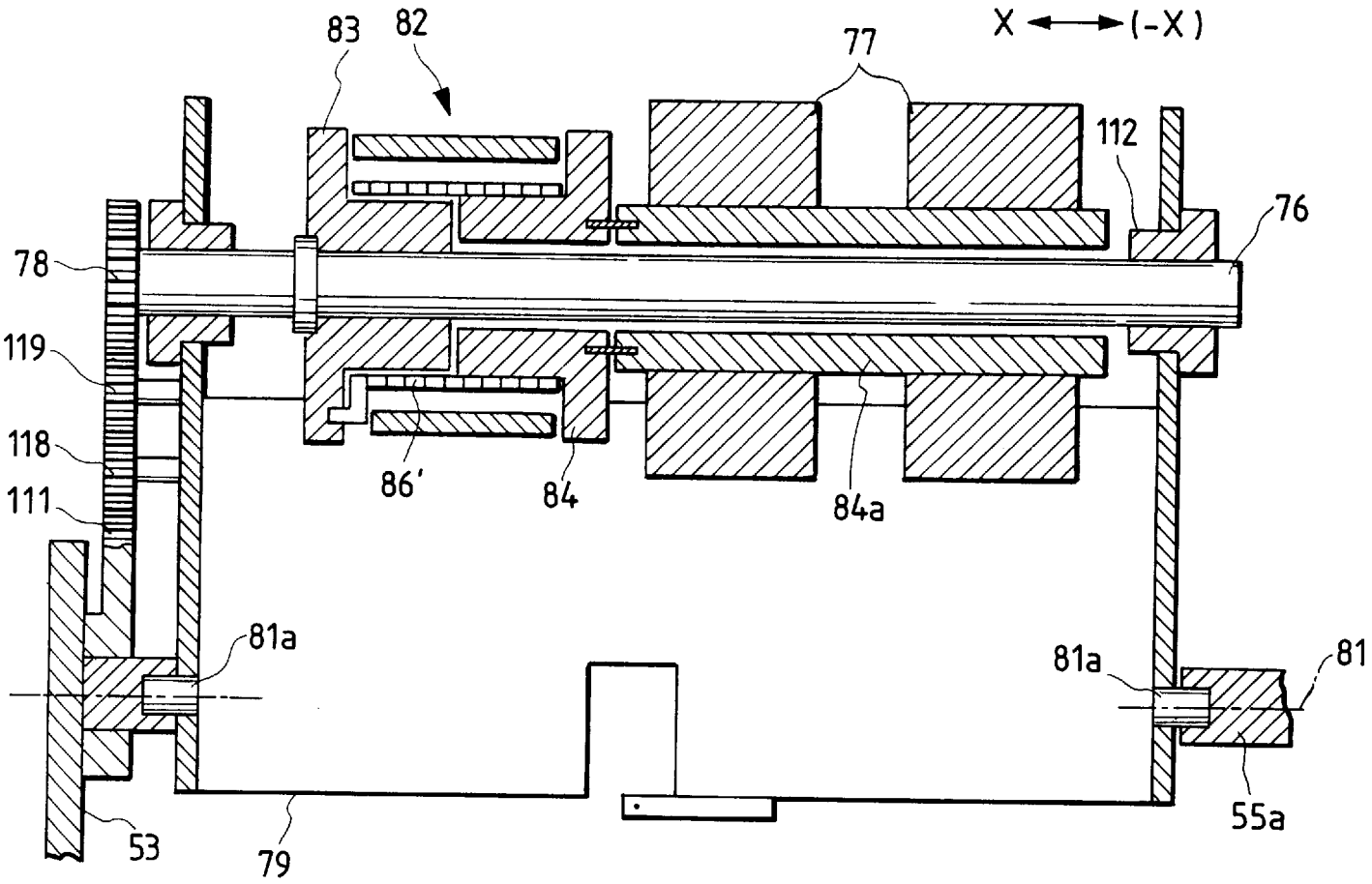
FIG. 20 is an explanatory illustration of the structure of a retard roller supporting mechanism of a paper feeder according to a seventh embodiment of the present invention, and this illustration corresponds to FIG. 15 which shows the fourth embodiment.
Figure 21:
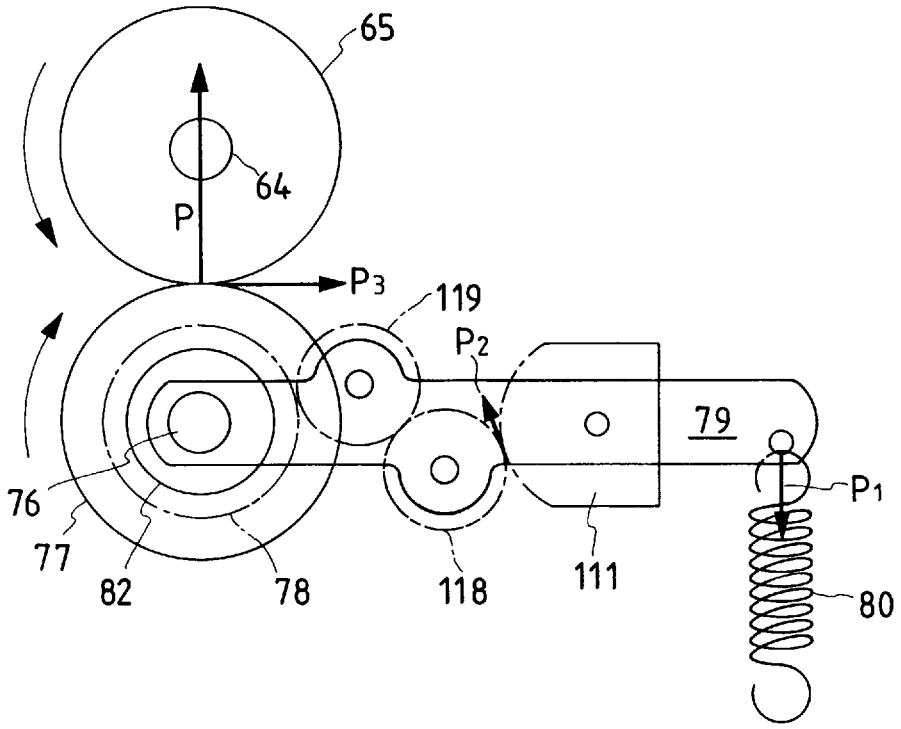
FIG. 21 is a side view of the retard roller supporting structure of the seventh embodiment of the present invention.

With reference to FIGS. 20 and 21, a paper feeder of the seventh embodiment of the present invention will now be described.

FIG. 20 is an explanatory illustration of the structure for supporting the retard rollers of the paper feeder of the seventh embodiment of the present invention.

FIG. 20 corresponds to FIG. 15 that illustrates the paper feeder of the fourth embodiment. FIG. 21 is a side view of the structure for supporting the retard rollers of the seventh embodiment.

In the descriptions of the seventh embodiment, the constituent elements which are the same as those of the fourth embodiment will be given the same reference numerals, and their detailed descriptions will be omitted.

The seventh embodiment is different from the fourth embodiment in only the following point:

Although the pressing gear 78' and the fixed gear 111 are in direct mesh with each other in the fourth embodiment shown in FIGS. 15 and 16, the pressing gear 78 ' is in mesh with the fixed gear 111 via idler gears 118 and 119 disposed on the pivotal support member 79, as shown in FIGS. 20 and 21.

As in the fourth embodiment, the paper is separated sheet by sheet by applying the braking force acting on the retard rollers 77 to the paper introduced into the nipping section by the torque limiter 82 in the seventh embodiment. When the paper enters the nipping section between the feed rollers 65 and the retard rollers 77, the force P2 (see FIG. 21) develops, as a result of which the pressing force (i.e., the retarding pressure ) P increases. The braking force acting on the paper is eventually increased.

Eighth Embodiment

A paper feeder according to an eighth embodiment of the present invention will now be described with reference to FIGS. 22 to 25.

Figure 22:
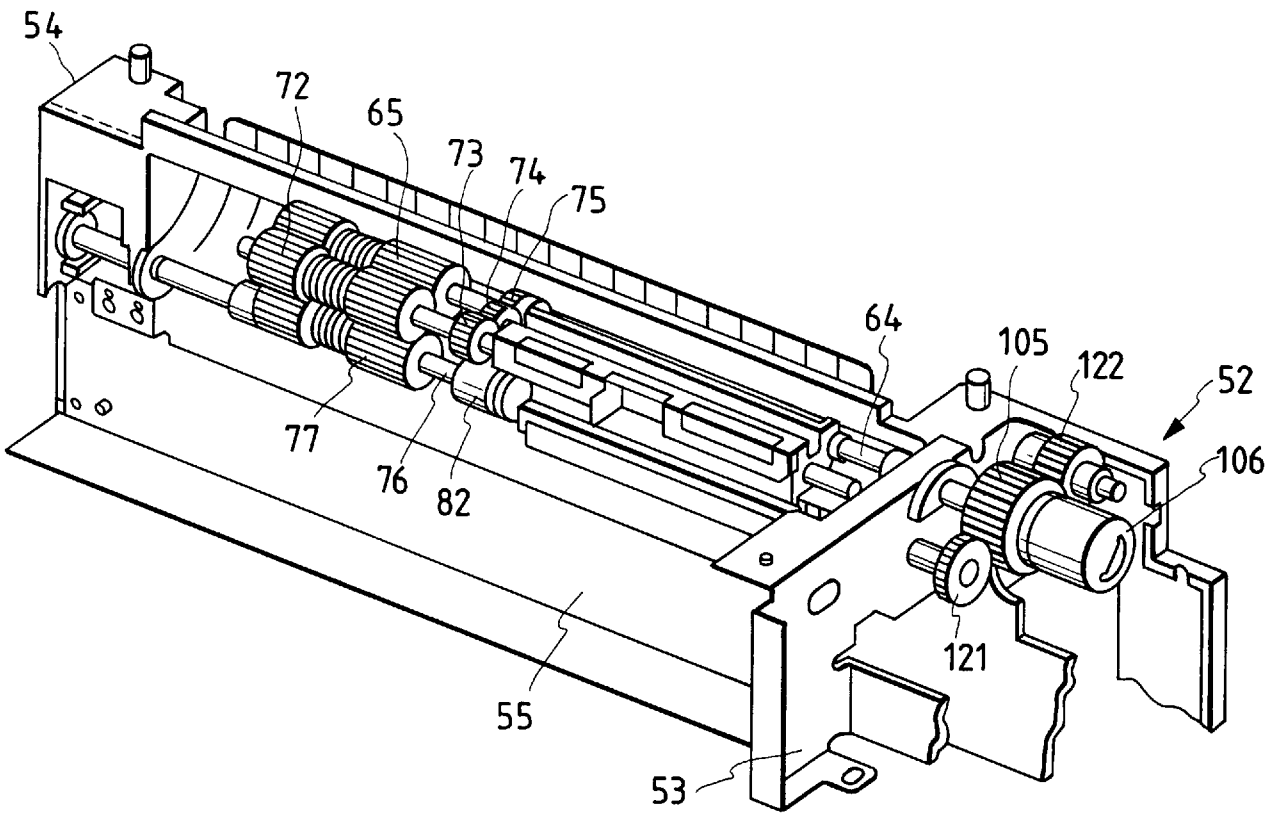
FIG. 22 is a perspective view of a paper feeder according to an eighth embodiment of the present invention, and this drawing corresponds to FIG. 12 which shows the fourth embodiment.
Figure 23:
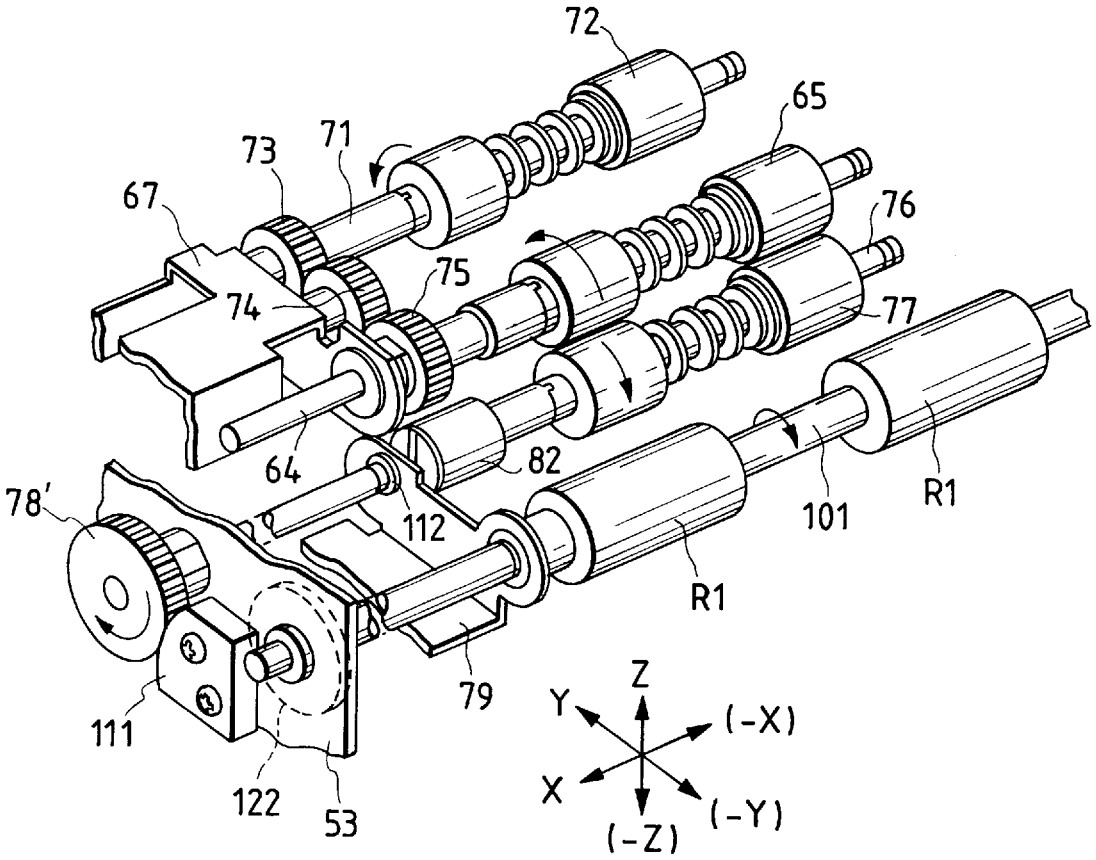
FIG. 23 is a perspective view of the principle elements of the eighth embodiment which shows the mechanism to press the retard rollers against the feed rollers.
Figure 24:
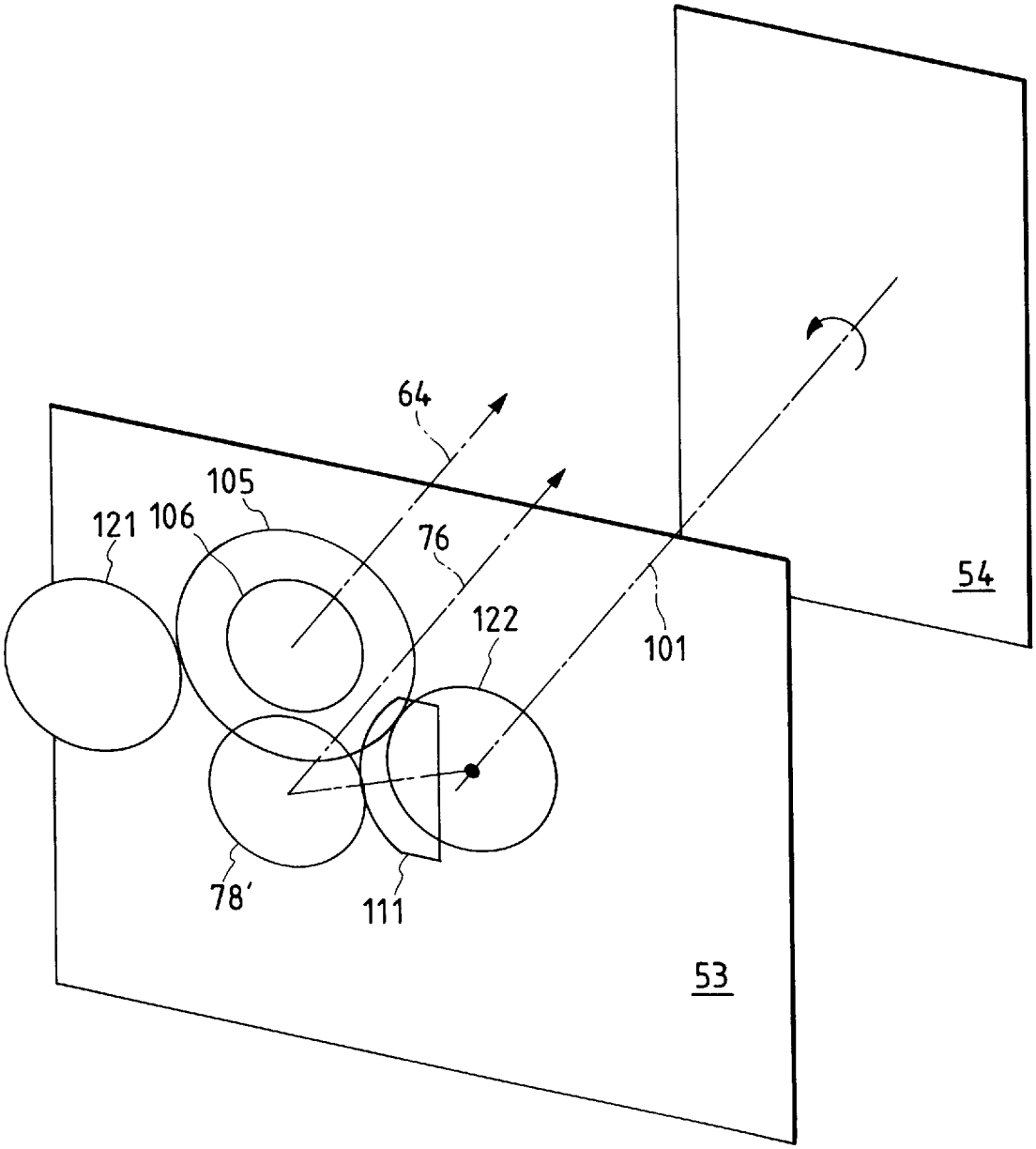
FIG. 24 is an explanatory illustration of a power transmission mechanism of the paper feeder of the eighth embodiment.
Figure 25:
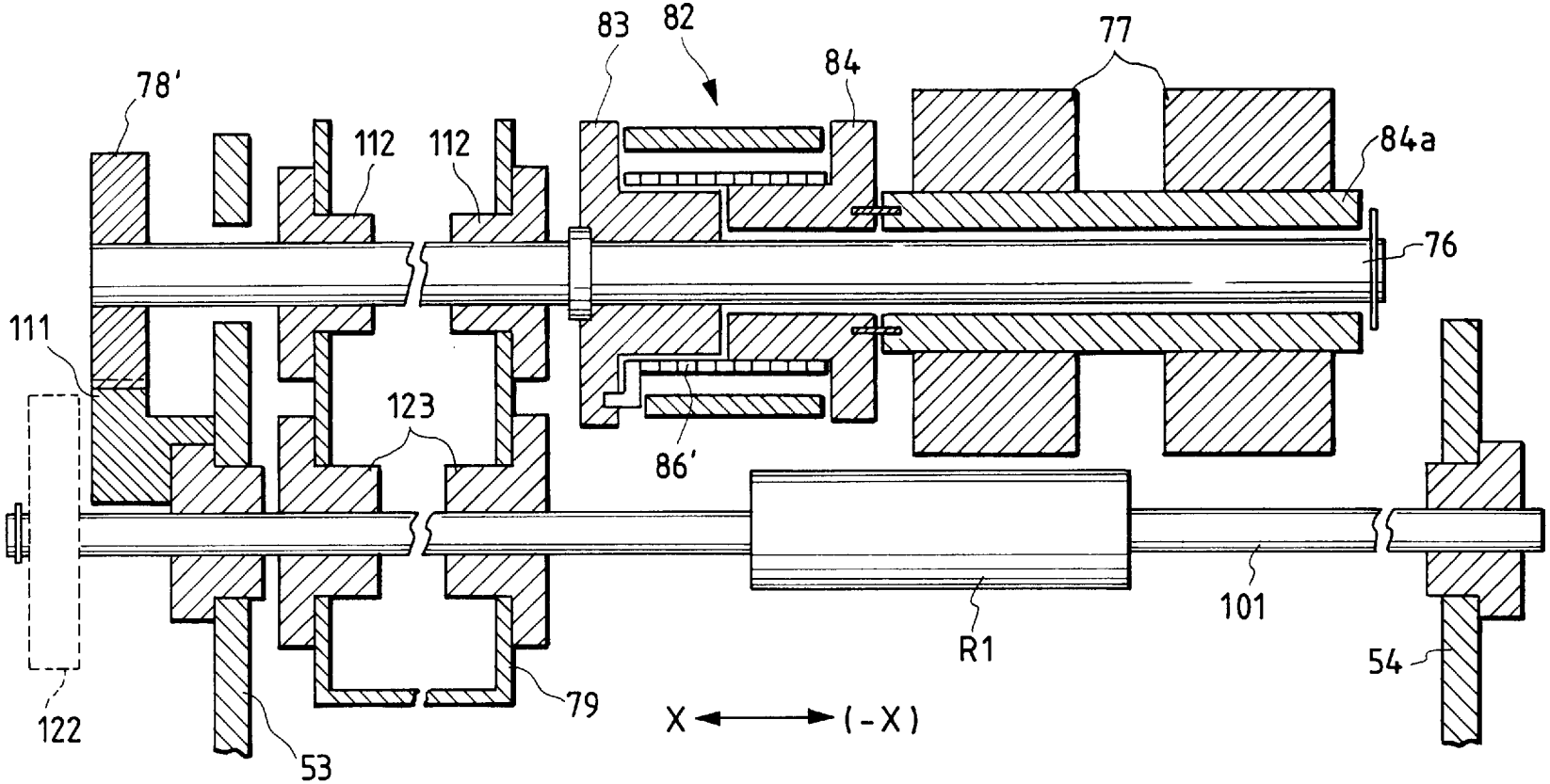
FIG. 25 is an explanatory illustration of retard roller braking unit of the paper feeder of the eighth embodiment.
Figure 26:
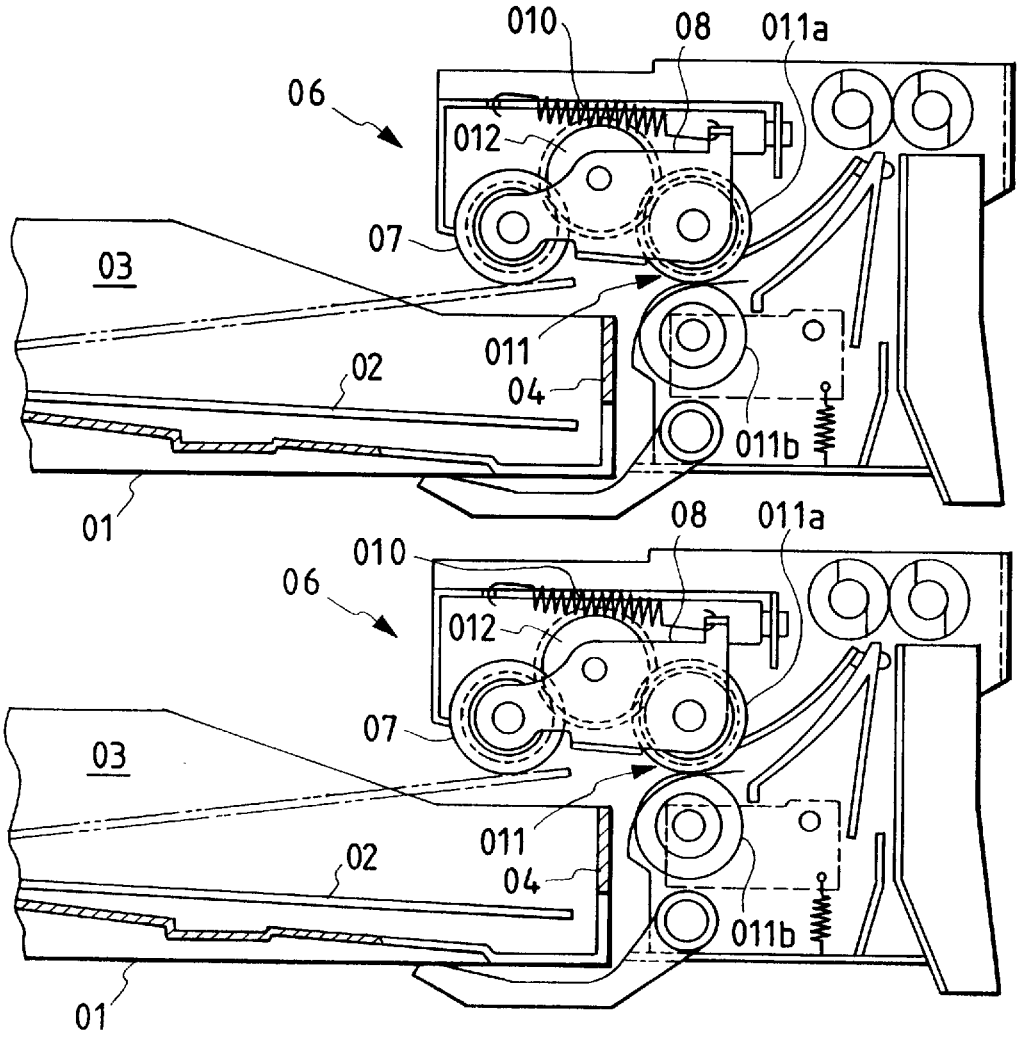
FIG. 26 is an explanatory illustration of a traditional paper feeder which feeds paper from a paper feed tray.
Figure 27:
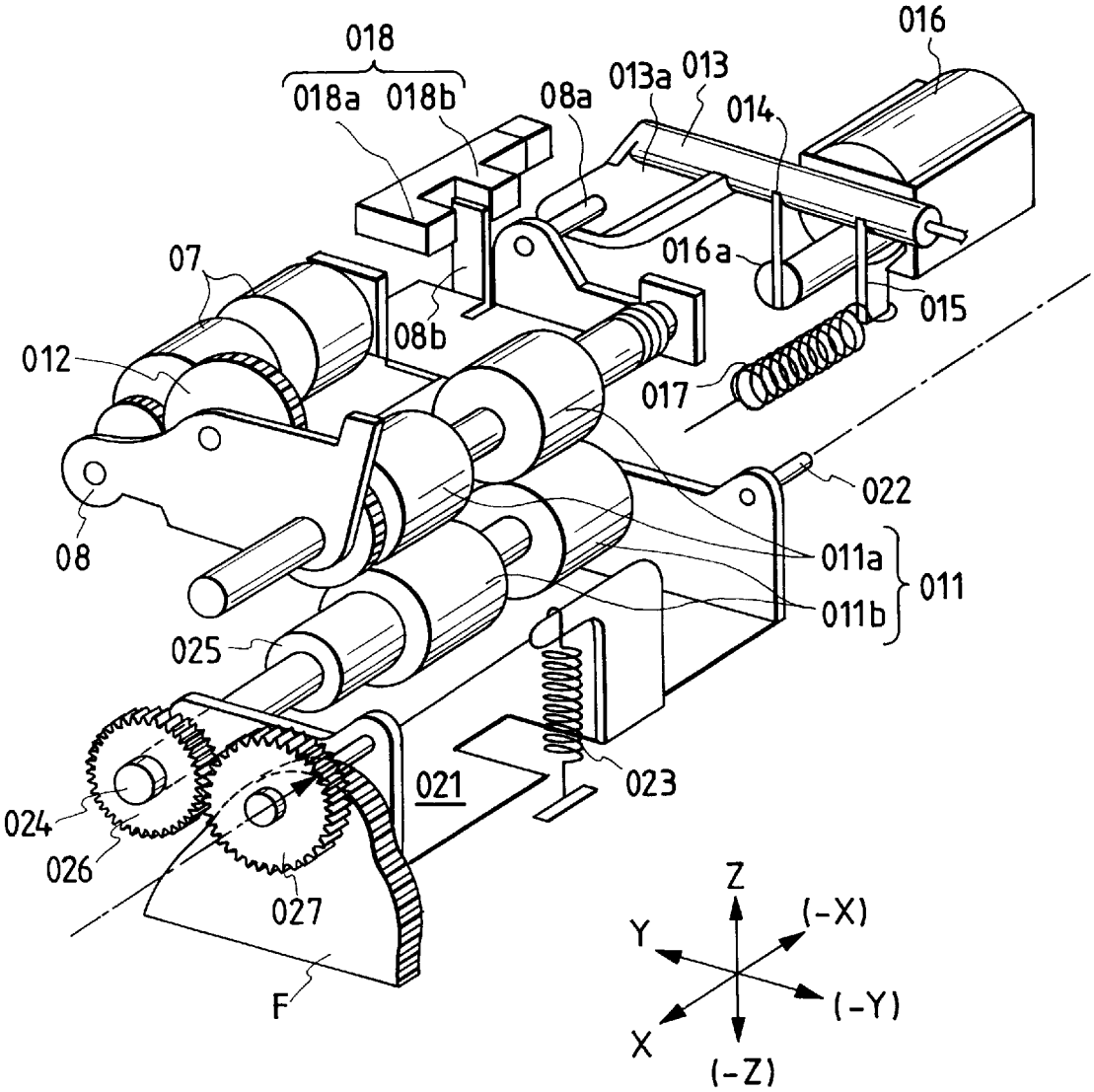
FIG. 27 is a perspective view of the principle elements of the traditional paper feeder which feeds the paper from the paper feed tray.
Figure 28:
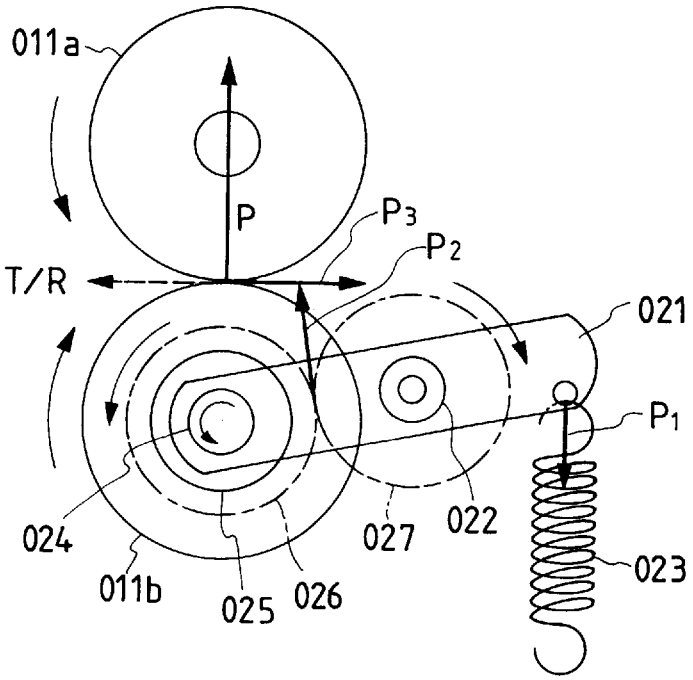
FIG. 28 is an explanatory illustration which shows the operation of the traditional paper feeder shown in FIGS. 26 and 27.
Figure 29A:
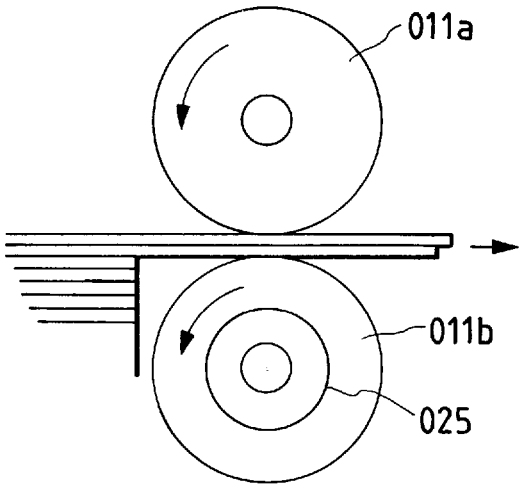
FIGS. 29A to 29C are explanatory illustrations which show the operation of the traditional paper feeder in the case where a retard roller 011*b* is reversely rotated, and is not reversely rotated, so as to return the paper to a paper feed tray 01 when two sheets of paper enter a nipping section between a feed roller 011*a* and the retard roller 011*b*.
Figure 29B:
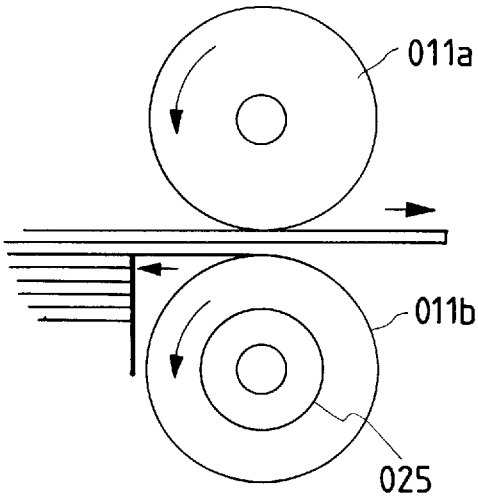
Figure 29C:
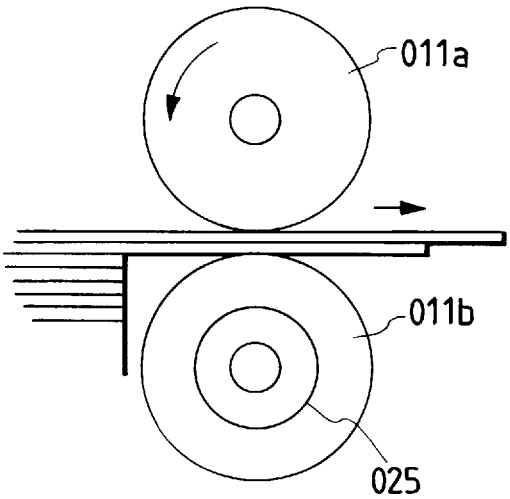
Figure 30A:
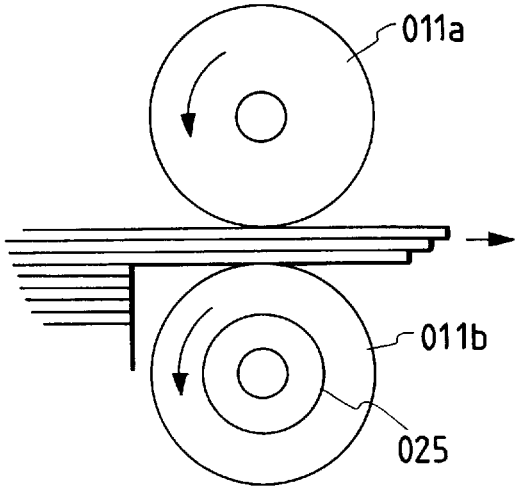
FIGS. 30A to 30C are explanatory illustrations which show the operation of the traditional paper feeder in the case where the retard roller 011*b* is reversely rotated, and is not reversely rotated, so as to return the paper to the paper feed tray 01 when three sheets of paper enter the nipping section between the feed roller 011*a* and the retard roller 011*b*.
Figure 30B:
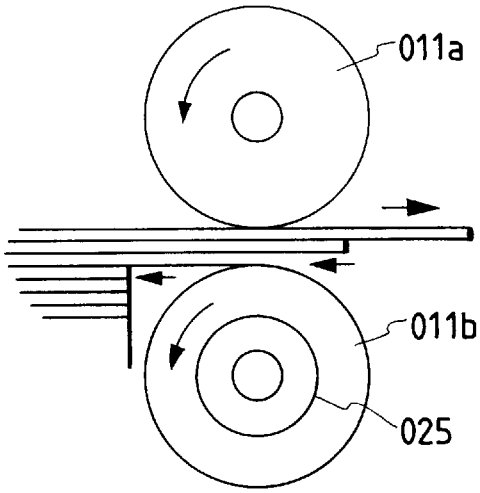
Figure 30C:
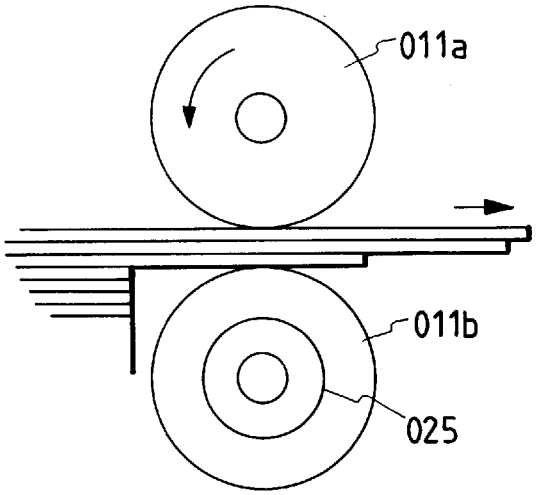

FIG. 22 is a perspective view of the paper feeder according to the eighth embodiment of the present invention and corresponds to FIG. 12 that shows the fourth embodiment. FIG. 23 is a perspective view of the principle elements of the paper feeder of the eighth embodiment. FIG. 23 shows a mechanism to press feed rollers against retard rollers. FIG. 24 is an explanatory illustration of a mechanism to transmit the power to the paper feeder of the eighth embodiment. FIG. 25 is an explanatory illustration of unit for braking the retard rollers of the paper feeder of the eighth embodiment.

In the descriptions of the eighth embodiment, the constituent elements which are the same as those of the fourth embodiment are assigned the same reference numerals, and their detailed explanations will be omitted.

The eight embodiment is different from the fourth embodiment in only the following points:

The drive roller R1 that forms the transport roller R is integrally incorporated into the paper feed unit U1 of the eighth embodiment which acts as the paper feeder.

The paper feed unit U1 is provided with a unit frame 52. The unit frame 52 is equipped with the front frame 53, the rear frame 54, the joint frame 55 which connects the front frame 53 with the rear frame 54, or the like.

The front frame 53 supports a drive unit consisting of a drive motor (not shown), a gear 121 (see FIGS. 22 and 23) which is rotated by the drive motor, or the like.

As shown in FIGS. 23 to 25, the transport drive roller shaft 101 is rotatably supported by the front frame 53 and the rear frame 54. The gear 122 is fixed to the front end of the transport drive roller shaft 101. The transport drive roller shaft 101 and the gear 122 rotate in an integrated fashion.

The front frame 53 supports the gear 105 which mesh with the gears 121 and 122, as shown in FIGS. 22 and 25.

The gear 105 is connected to the feed roller shaft 64 via the clutch 106. This feed roller shaft 64 is rotatably supported by the front frame 53 and the joint frame 55.

The feed rollers 65 and the gear 75 are fitted to the feed roller shaft 64, as shown in FIG. 23, and they are arranged to constantly rotate. The pivotal arm 67 is rotatably supported by the feed roller shaft 64. Namely, when the gear 121 rotates, the rotating force of the gear 121 is transmitted to the gear 105. When the clutch 106 is in the ON state, the feed roller shaft 64, the feed rollers 65, and the gear 75 (see FIGS. 22 and 23) rotate together with the gear 105 in an integrated fashion.

The pickup roller shaft 71 which extends in the front-to-back direction (i.e., ,in the X-axis direction) is rotatably supported on the left end portion (i.e., the front end portion or the end portion in the Y direction) of the pivotal arm 67 which is pivotally supported on the feed roller shaft 64. The pickup rollers 72 and the gear 73 are fitted to the pickup roller shaft 71.

The gear 73 is in mesh with the gear 75 fitted to the feed roller shaft 64 via the idler gear 74 rotatably attached to the pivotal arm 67. As a result, when the feed roller shaft 64 rotates, the feed rollers 65 and the gear 75 fitted to the feed roller shaft 64 rotate. Simultaneously, the gear 73 rotates via the gear 75 and the idler gear 74. As a result of the rotation of the gear 73, the pickup roller shaft 71 and the pickup rollers 72 rotate.

The pivotal arm 67 downwardly pivots by means of gravity and the spring (not shown), and the pickup rollers 72 constantly come into contact with the paper loaded in the paper feed trays 21 to 25.

The electromagnetic clutch 106 (see FIG. 22) is turned on every time one sheet of paper is fed, whereby the rotating force of the gear 105 is transmitted to the feed roller shaft 64, the feed rollers 65, the pickup rollers 72, or the like.

Therefore, the position control carried out by the pivotal arm 67 is not executed in the eighth embodiment.

The retard roller shaft 76 is positioned below the feed rollers 65, as shown in FIGS. 22 and 25.

The pivotal support member 79 that supports the retard roller shaft 76 is pivotally supported by the transport drive roller shaft 101 by way of bearings 123 and 125 (see FIG. 25), as shown in FIGS. 23 to 25. In other words, the transport drive roller shaft 101 is used as a pivot for pivotally supporting the pivotal support member 79 in the eighth embodiment.

The retard roller shaft 76 is rotatably supported by the pivotal support member 79 via the bearings 112, 112 (see FIGS. 23 and 25).

The retard rollers 72 are supported by the retard roller shaft 76 via the torque limiter 82. Further, the pressing gear 78' is fixed to the front end of the retard roller shaft 76. The pressing gear 78' is in mesh with the fixed gear 111 (see FIGS. 23 to 25).

The pivotal support member 79 receives a rotating force by means of a tension spring (not shown) which is the same as the tension spring 80 of the fourth embodiment, whereby the retard rollers 77 are pressed against the feed rollers 65.

The operation of the paper feeder having the above-described elements according to the eighth embodiment will now be described.

The torque limiter 82 of the eighth embodiment operates in the same manner as that of the fourth embodiment. Therefore, when the rotating force of the retard roller 77 is transmitted to the input hub 84 of the torque limiter 82, the wrap spring 86' provided between the input hub 84 and the output hub 83 rotates together with the input hub 84 while they come into frictional contact with each other, as a result of which the braking force acts on the input hub 84.

When the pressing gear 78' rotates together with the output hub 83, the pressing gear 78' moves along the fixed gear 111. As can be seen from FIG. 23, the pivotal support member 79 pivots on the transport drive roller shaft (i.e., the pivot of the eighth embodiment) 101 in conjunction with the movement of the pressing gear 78'. Then, the retard rollers 77 are pressed against the feed rollers 65, and the pressing force exerted on the feed rollers 65 from the retard rollers 77, that is, the retarding pressure increases.

Therefore, as in the fourth embodiment, if a plurality of sheets of paper enter the nipping section between the feed rollers 65 and the retard rollers 77 after having been fed by the pickup rollers 72, the paper which comes into contact with the retard rollers 77 receives the braking force. The top sheet of paper is separated from the lower sheet by means of this braking force.

Further, the paper has already moved in the direction in which it is transported the moment when it enters the nipping section between the feed rollers 65 and the retard rollers 77. The retard rollers 77 rotate together with the movement of the paper. At this time, the pressing gear 78' rotates, whereby the retarding pressure increases as a result of receipt of reaction from the fixed gear 111. Consequently, a large braking force acts on the paper, it is possible to obtain a paper feeder having an improved function of separating a plurality of sheets of paper introduced to the nipping section.

Modified Example

Although the embodiments of the present invention have been described in a detailed manner, the present invention is not limited to them. Various modifications of the present invention are conceivable without departing from the scope and spirit of the invention covered by the appended claims. Modified embodiments of the present invention will be described as follows:

(1) An appropriate number of idler gears (including zero) can be disposed between the gears 78 and 87 of the first embodiment and between the pressing gear 87' and the fixed gear 111 of the fourth embodiment.

(2) The arm position control member (arm up-and-down lever) 68 may be constructed from the arm up-and-down shaft 69, and a separate member attached to the arm up-and-down shaft or a member being integral with the arm up-and-down shaft. For example, the arm position control member may be constructed from a cam surface which is integral with an outer periphery of the arm up-and-down shaft 69. In this case, the pivotal arm 67 may be arranged so as to pivot in response to the rotation of the cam surface by engaging a part of the pivotal arm 67 with the cam surface.

(3) It is possible to omit the pressing and releasing mechanism for bringing the pickup rollers 72 into contact with or releasing them from the paper from the paper feeder of the first embodiment. In this case, the pickup rollers 72 are constantly brought into contact with the paper, and it is possible to rotate the pickup rollers 72 only when required. (H04) Various types of conventionally known braking unit other than the torque limiter can be adopted as the retard roller braking unit.

The previously described paper feeder of the present invention produces the following effects:

It is possible for the paper feeder to separately transport the paper without reversely rotating the retard rollers.

The retard rollers are not rotated in a reverse direction to the direction in which the paper is transported, and hence the load torque of the feed rollers becomes smaller, which in turn results in lower power consumption.

Since the retard rollers are not driven, noise can be reduced accordingly.

What is claimed is:

1. A paper feeding device comprising:

a pickup roller for feeding paper loaded in a paper feed tray;

a pickup roller and a retard roller which separately transport the paper received from the paper feed tray sheet by sheet;

rotary drive means for rotating said feed roller in a paper transporting direction;

pressing means for pressing said retard roller against said feed roller, said retard roller being rotatable together with a rotation of a peripheral surface of said feed roller when pressed against said feed roller when said feed roller rotates;

retard roller braking means for exerting a braking force on said retard roller when said retard roller rotates, the retard roller braking means comprising:

a torque limiter which comprises an input element, an output element and a coupling that couples said output element to said input element such that running torque is transmitted between said in put and output elements, both the input element and the output element being rotatable relatively to each other, running torque transmitted between said input and output elements being limited by the coupling;

rotating force transmission means for transmitting a rotation of said retard roller to said in put element; and output element rotation suppressing means for preventing a rotation of said output element; and pressing force increasing means for converting a torque of said retard roller into a pressing force exerted on said feed roller from said retard roller.

2. A paper feeding device as defined in claim 1, further comprising: an unrotative retard roller support shaft which supports said retard roller, said torque limiter being interposed between said retard roller and said unrotative retard roller support shaft.

3. A paper feeding device as defined in claim 2, wherein the pressing force increasing means comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

4. A paper feeding device as defined in claim 1, further comprising: an unrotative fixed member and a rotating ganged member which rotates together with a rotation of said retard roller, said torque limiter being interposed between said rotating ganged member and said unrotative fixed member.

5. A paper feeding device as defined in claim 4, wherein the pressing force increasing means comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

6. A paper feeding device as defined in claims 1, wherein the pressing force increasing means comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

7. A paper feeding device comprising:

a pickup roller for feeding paper loaded in a paper feed tray;

a feed roller and a retard roller which separately transport the paper received from the paper feed tray sheet by sheet;

rotary drive means for rotating said feed roller in a paper transporting direction;

pressing means for pressing said retard roller against said feed roller, said retard roller being rotatable together with a rotation of a peripheral surface of said feed roller when pressed against said feed roller when said feed roller rotates;

retard roller braking means for exerting a braking force on said retard roller when said retard roller rotates, the retard roller braking means comprising:

a torque limiter which comprises an input element, an output element and a coupling that couples said output element to said input element such that running torque is transmitted between said input and output elements, both the input element and the output element being rotatable relatively to each other, running torque transmitted between said input and output elements being limited by the coupling;

rotating force transmission means for transmitting a rotation of said retard roller to said input element; and output element rotation suppressing means for preventing a rotation of said output element; and an unrotative retard roller support shaft which supports said retard roller, said torque limiter being interposed between said retard roller and said unrotative retard roller support shaft.

8. A paper feeding device as defined in claim 7, wherein the pressing force increasing means comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

9. A paper feeding device comprising:

a pickup roller for feeding paper loaded in a paper feed tray;

a feed roller and a retard roller which separately transport the paper received from the paper feed tray sheet by sheet;

rotary drive means for rotating said feed roller in a paper transporting direction;

pressing means for pressing said retard roller against said feed roller, said retard roller being rotatable together with a rotation of a peripheral surface of said feed roller when pressed against said feed roller when said feed roller rotates;

retard roller braking means for exerting a braking force on said retard roller when said retard roller rotates, the retard roller braking means comprising:

a torque limiter which comprises an input element, an output element and a coupling that couples said output element to said input element such that running torque is transmitted between said input and output elements, both the input element and the output element being rotatable relatively to each other, running torque transmitted between said input and output elements being limited by the coupling;

rotating force transmission means for transmitting a rotation of said retard roller to said input element; and output element rotation suppressing means for preventing a rotation of said output element; and an unrotative fixed member and a rotating ganged member which rotates together with a rotation of said retard roller, said torque limiter being interposed between said rotating ganged member and said unrotative fixed member.

10. A paper feeding device as defined in claim 9, wherein the pressing force increasing means comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

11. A paper feeding device comprising:

a pickup roller for feeding paper loaded in a paper feed tray;

a feed roller and a retard roller which separately transport the paper received from the paper feed tray sheet by sheet;

a rotary drive coupled to the feed roller to rotate said feed roller in a paper transporting direction;

a presser that presses said retard roller against said feed roller, said retard roller being rotatable together with a rotation of a peripheral surface of said feed roller when pressed against said feed roller when said feed roller rotates;

a retard roller brake that exerts a braking force on said retard roller when said retard roller rotates, the retard roller brake comprising:

a torque limiter which comprises an input element, an output element and a coupling that couples said output element to said input element such that running torque is transmitted between said input and output elements, both the input element and the output element being rotatable relatively to each other, running torque transmitted between said input and output elements being limited by the coupling;

a rotating force transmission that transmits a rotation of said retard roller to said input element; and an output element rotation suppresser that prevents a rotation of said output element; and a pressing force converter that converts a torque of said retard roller into a pressing force exerted on said feed roller from said retard roller.

12. A paper feeding device as defined in claim 11, further comprising: an unrotative retard roller support shaft which supports said retard roller, said torque limiter being interposed between said retard roller and said unrotative retard roller support shaft.

13. A paper feeding device as defined in claim 12, wherein the pressing force converter comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

14. A paper feeding device as defined in claim 11, further comprising: an unrotative fixed member and a rotating ganged member which rotates together with a rotation of said retard roller, said torque limiter being interposed between said rotating ganged member and said unrotative fixed member.

15. A paper feeding device as defined in claim 14, wherein the pressing force converter comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

16. A paper feeding device as defined in claim 11, wherein the pressing force converter comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

17. A paper feeding device comprising:

a pickup roller for feeding paper loaded in a paper feed tray;

a feed roller and a retard roller which separately transport the paper received from the paper feed tray sheet by sheet;

a rotary drive coupled to the feed roller to rotate said feed roller in a paper transporting direction;

a presser that presses said retard roller against said feed roller, said retard roller being rotatable together with a rotation of a peripheral surface of said feed roller when pressed against said feed roller when said feed roller rotates;

a retard roller brake that exerts a braking force on said retard roller when said retard roller rotates, the retard roller brake comprising:

a torque limiter which comprises an input element, an output element and a coupling that couples said output element to said input element such that running torque is transmitted between said input and output elements, both the input element and the output element being rotatable relatively to each other, running torque transmitted between said input and output elements being limited by the coupling;

a rotating force transmission that transmits a rotation of said retard roller to said input element; and an output element rotation suppresser that prevents a rotation of said output element; and an unrotative retard roller support shaft which supports said retard roller, said torque limiter being interposed between said retard roller and said unrotative retard roller support shaft.

18. A paper feeding device as defined in claim 17, wherein the pressing force converter comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

19. A paper feeding device comprising:

a pickup roller for feeding paper loaded in a paper feed tray;

a feed roller and a retard roller which separately transport the paper received from the paper feed tray sheet by sheet;

a rotary drive coupled to the feed roller to rotate said feed roller in a paper transporting direction;

a presser that presses said retard roller against said feed roller, said retard roller being rotatable together with a rotation of a peripheral surface of said feed roller when pressed against said feed roller when said feed roller rotates;

a retard roller brake that exerts a braking force on said retard roller when said retard roller rotates, the retard roller brake comprising:

a torque limiter which comprises an input element, an output element and a coupling that couples said output element to said input element such that running torque is transmitted between said input and output elements, both the input element and the output element being rotatable relatively to each other, running torque transmitted between said input and output elements being limited by the coupling;

a rotating force transmission that transmits a rotation of said retard roller to said input element; and an output element rotation suppresser that prevents a rotation of said output element; and an unrotative fixed member and a rotating ganged member which rotates together with a rotation of said retard roller, said torque limiter being interposed between said rotating ganged member and said unrotative fixed member.

20. A paper feeding device as defined in claim 19, wherein the pressing force converter comprises:

a pivotal support member which pivots on a pivot and supports said retard roller support shaft on a leading end thereof;

a fixed gear which is formed along a circular arc centered at the pivot; and a pressing gear supported by said pivotal support member, said pressing gear rotating together with a rotation of the retard roller, said pressing gear meshing with said fixed gear.

21. A method of feeding paper comprising the steps of:

receiving paper from a paper feed tray;

separately transporting the paper received from the paper feed tray with a feed roller and a retard roller;

rotating the feed roller in a paper transporting direction;

pressing the retard roller against the feed roller, the retard roller being rotatable together with a rotation of a peripheral surface of the feed roller when pressed against the feed roller when the feed roller rotates;

exerting a braking force on the retard roller when the retard roller rotates, the braking force being exerted by suppressing rotation of an output element coupled to, and rotatable relative to, an input element by limiting torque transmitted between the input and output elements and transmitting rotation of the retard roller to the input element; and converting a torque of the retard roller into a pressing force exerted on the feed roller from the retard roller.

22. A method of feeding paper comprising the steps of:

receiving paper from a paper feed tray;

separately transporting the paper received from the paper feed tray with a feed roller and a retard roller;

rotating the feed roller in a paper transporting direction;

pressing the retard roller against the feed roller, the retard roller being rotatable together with a rotation of a peripheral surface of the feed roller when pressed against the feed roller when the feed roller rotates; and exerting a braking force on the retard roller when the retard roller rotates, the braking force being exerted by suppressing rotation of an output element coupled to, and rotatable relative to, an input element by limiting torque transmitted between the input and output elements and transmitting rotation of the retard roller to the input element, wherein the retard roller is supported by an unrotative retard roller support shaft and the torque transmitted between the input and output elements is limited by a torque limiter interposed between the retard roller and the unrotative retard roller support shaft.

23. A method of feeding paper comprising the steps of:

receiving paper from a paper feed tray;

separately transporting the paper received from the paper feed tray with a feed roller and a retard roller;

rotating the feed roller in a paper transporting direction;

pressing the retard roller against the feed roller, the retard roller being rotatable together with a rotation of a peripheral surface of the feed roller when pressed against the feed roller when the feed roller rotates; and exerting a braking force on the retard roller when the retard roller rotates, the braking force being exerted by suppressing rotation of an output element coupled to, and rotatable relative to, an input element by limiting torque transmitted between the input and output elements and transmitting rotation of the retard roller to the input element, wherein the torque transmitted between the input and output elements is limited by a torque limiter interposed between an unrotative fixed member and a rotating ganged member that rotates together with a rotation of the retard roller.

* * * * *